US006986679B1

(12) United States Patent
Aronson et al.

(10) Patent No.: US 6,986,679 B1
(45) Date of Patent: Jan. 17, 2006

(54) TRANSCEIVER MODULE CAGE FOR USE WITH MODULES OF VARYING WIDTHS

(75) Inventors: Lewis B. Aronson, Los Altos, CA (US); Don Ice, Milpitas, CA (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 10/661,941

(22) Filed: Sep. 12, 2003

Related U.S. Application Data

(60) Provisional application No. 60/410,858, filed on Sep. 14, 2002.

(51) Int. Cl.
*H01R 13/64* (2006.01)

(52) U.S. Cl. ..... 439/374; 439/170; 439/541.5

(58) Field of Classification Search ..... 439/676, 439/541.5, 928.1, 331, 374, 170, 297; 385/88, 385/53, 92; 361/395, 756, 796, 684
See application file for complete search history.

(56) References Cited

U.S. PATENT DOCUMENTS

| | | | | |
|---|---|---|---|---|
| 4,083,619 | A | 4/1978 | McCormick et al. | |
| 4,387,956 | A | 6/1983 | Cline | |
| 4,678,264 | A | 7/1987 | Bowen et al. | |
| 4,798,430 | A | 1/1989 | Johnson et al. | |
| 4,993,803 | A | 2/1991 | Saverison et al. | |
| 5,039,194 | A | 8/1991 | Block et al. | |
| 5,067,041 | A * | 11/1991 | Cooke et al. | 361/685 |
| 5,069,522 | A | 12/1991 | Block et al. | |
| 5,071,219 | A | 12/1991 | Yurtin et al. | |
| 5,195,897 | A | 3/1993 | Kent et al. | |
| 5,202,943 | A | 4/1993 | Carden et al. | |
| 5,256,080 | A | 10/1993 | Bright | |
| 5,329,428 | A | 7/1994 | Block et al. | |
| 5,416,871 | A | 5/1995 | Takahashi et al. | |
| 5,467,254 | A * | 11/1995 | Brusati et al. | 361/799 |
| 5,487,678 | A | 1/1996 | Tsuji et al. | |
| 5,528,408 | A | 6/1996 | McGinley et al. | |
| 5,546,281 | A | 8/1996 | Poplawski et al. | |
| 5,561,727 | A | 10/1996 | Akita et al. | |
| 5,591,047 | A * | 1/1997 | Yamada et al. | 439/541.5 |
| 5,596,665 | A | 1/1997 | Kurashima et al. | |
| 5,734,558 | A | 3/1998 | Poplawski et al. | |
| 5,767,999 | A | 6/1998 | Kayner | |
| 5,818,696 | A * | 10/1998 | Knoop | 361/730 |
| 5,820,398 | A | 10/1998 | Stabroth et al. | |
| 5,879,173 | A | 3/1999 | Poplawski et al. | |
| 5,901,263 | A | 5/1999 | Gaio et al. | |

(Continued)

FOREIGN PATENT DOCUMENTS

DE 200 05 316 U1 9/2000

(Continued)

OTHER PUBLICATIONS

*Fiber Optic Module Interface Attachment,* Research Disclosure, Kenneth Mason Publications Ltd., England, No. 330, Oct. 1991.

(Continued)

*Primary Examiner*—Michael C. Zarroli
(74) *Attorney, Agent, or Firm*—Workman Nydegger

(57) ABSTRACT

A cage system capable of accommodating pluggable modules having different form factors is disclosed. The interior dimensions of a receptacle portion of the cage can be modified by selective orientation of a divider, or septum, device. Embodiments of the cage include EMI containment structures so as to minimize EMI emission. Other embodiments include heat sink structures that are disposed so as to absorb heat from modules received within the cage receptacles.

15 Claims, 22 Drawing Sheets

U.S. PATENT DOCUMENTS

| | | | | |
|---|---|---|---|---|
| 5,931,290 | A | 8/1999 | Wehrli, III et al. | |
| 5,947,435 | A | 9/1999 | Small | |
| 5,980,324 | A | 11/1999 | Berg et al. | |
| 6,050,658 | A | 4/2000 | O'Sullivan et al. | |
| 6,069,991 | A | 5/2000 | Hibbs-Brenner et al. | |
| 6,074,228 | A | 6/2000 | Berg et al. | |
| 6,081,431 | A | 6/2000 | Lemke | |
| 6,088,498 | A | 7/2000 | Hibbs-Brenner et al. | |
| 6,142,802 | A | 11/2000 | Berg et al. | |
| 6,142,828 | A | 11/2000 | Pepe | |
| 6,149,465 | A | 11/2000 | Berg et al. | |
| 6,169,295 | B1 | 1/2001 | Koo | |
| 6,229,708 | B1 | 5/2001 | Corbin, Jr. et al. | |
| 6,231,145 | B1 | 5/2001 | Lin | |
| 6,259,769 | B1 | 7/2001 | Page et al. | |
| 6,309,237 | B1 * | 10/2001 | Longueville | 439/267 |
| 6,430,053 | B1 | 8/2002 | Peterson et al. | |
| 6,434,015 | B1 | 8/2002 | Hwang | |
| 6,439,918 | B1 | 8/2002 | Togami et al. | |
| 6,494,623 | B1 | 12/2002 | Ahrens et al. | |
| 6,517,382 | B2 | 2/2003 | Flickinger et al. | |
| 6,524,134 | B2 | 2/2003 | Flickinger et al. | |
| 6,532,155 | B2 | 3/2003 | Green et al. | |
| 6,533,603 | B1 * | 3/2003 | Togami | 439/372 |
| 6,538,882 | B2 | 3/2003 | Branch et al. | |
| 6,544,055 | B1 | 4/2003 | Branch et al. | |
| 6,556,445 | B2 | 4/2003 | Medina | |
| 6,570,768 | B2 | 5/2003 | Medina | |
| 2002/0142649 | A1 | 10/2002 | Baugh et al. | |
| 2002/0150343 | A1 | 10/2002 | Chiu et al. | |
| 2003/0020986 | A1 | 1/2003 | Pang et al. | |
| 2003/0044129 | A1 | 3/2003 | Ahrens et al. | |
| 2003/0059167 | A1 | 3/2003 | Chiu et al. | |
| 2003/0100204 | A1 | 5/2003 | Hwang | |

FOREIGN PATENT DOCUMENTS

| | | |
|---|---|---|
| EP | 0 442 608 A2 | 8/1991 |
| EP | 0 456 298 A1 | 11/1991 |
| GB | 2 297 007 A | 7/1996 |
| JP | 4-165312 | 6/1992 |

OTHER PUBLICATIONS

T.R. Block et al., *Field Replaceable Optical Link Card,* IBM Technical Disclosure Bulletin, vol. 37, No. 02B, Feb. 1994.

Ronald L. Soderstrom et al., *CD Laser Optical Data Links for Workstations and Midrange Computers,* 43rd Electronic Components and Technology Conference 1993 Proceedings, pp. 505-509, Jun. 1993.

Agilent Technolgies, et al., *Small Form-factor Pluggable (SFP) Transceiver MultiSource Agreement (MSA), Cooperation Agreement for Small Form-Factor Pluggable Transceivers,* pp. 1-38, Sep. 14, 2000.

Ali Ghiasi, *XFP (10 Gigabit Small Form Factor Pluggable Module*), Revision 0.92, Jul. 19, 2002.

US 6,554,622, 04/2003, Engel et al. (withdrawn)

* cited by examiner

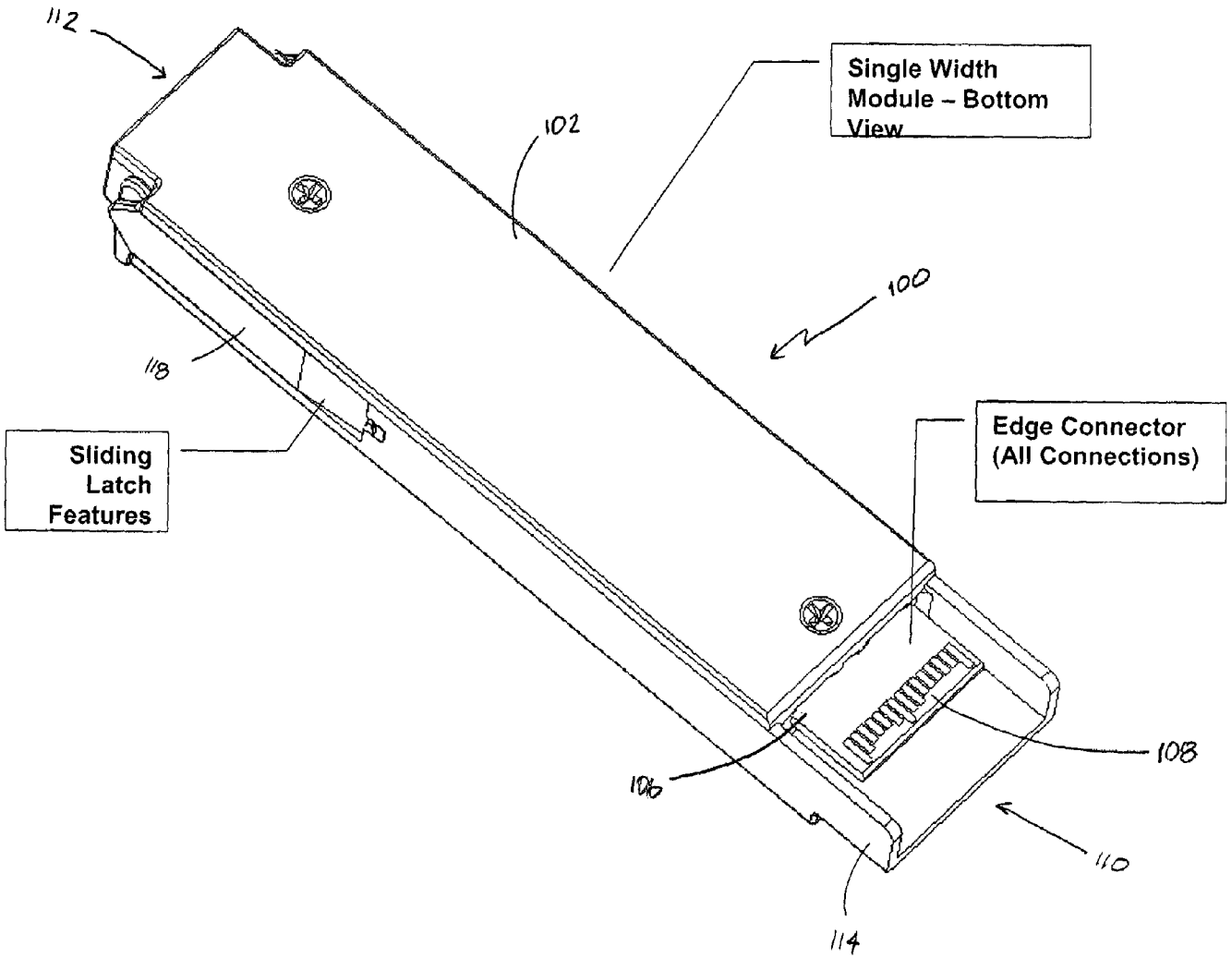
- FIGURE 2 -

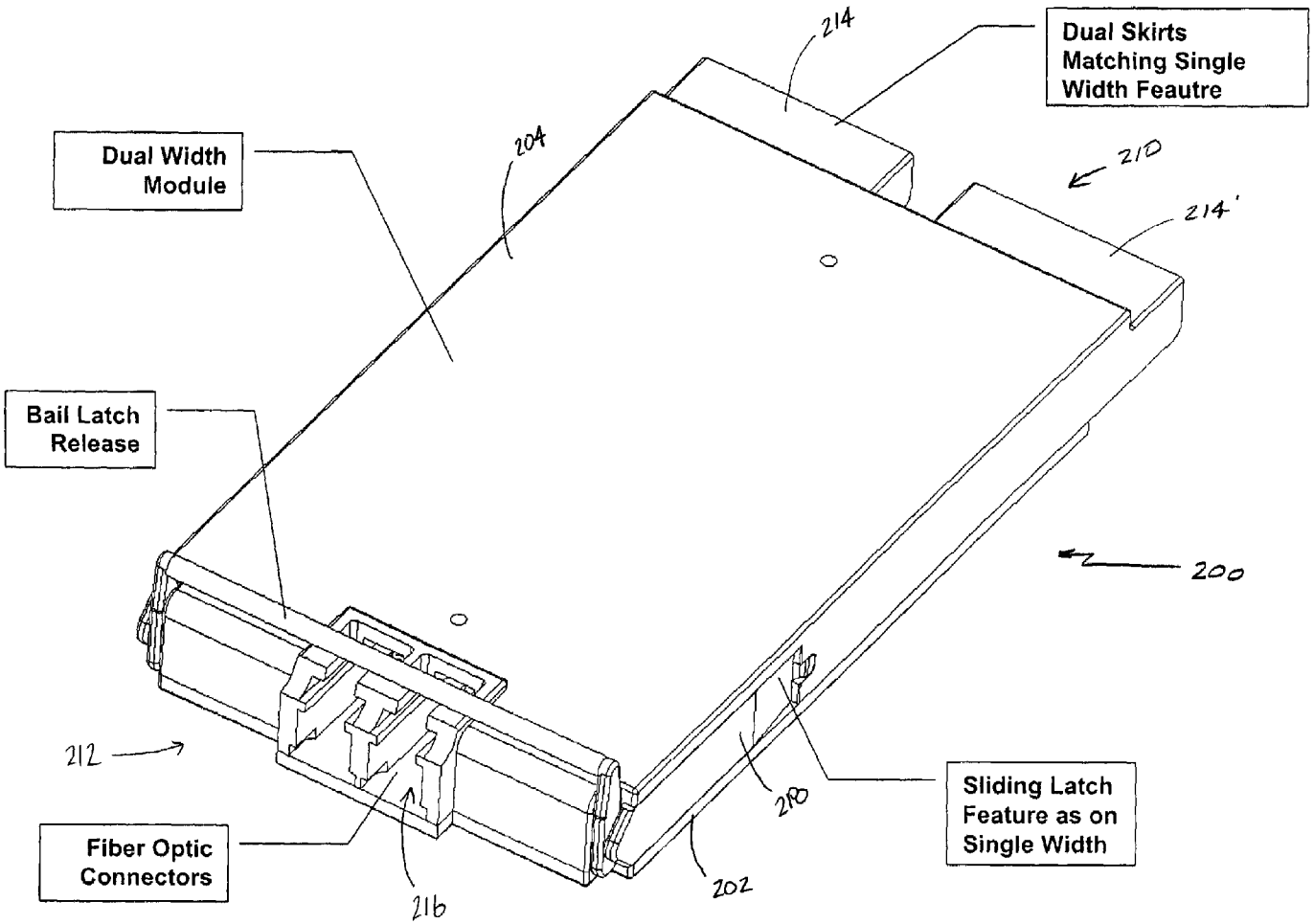
- FIGURE 3 -

Note: Choice of Full Connector (high speed signals) is Arbitrary

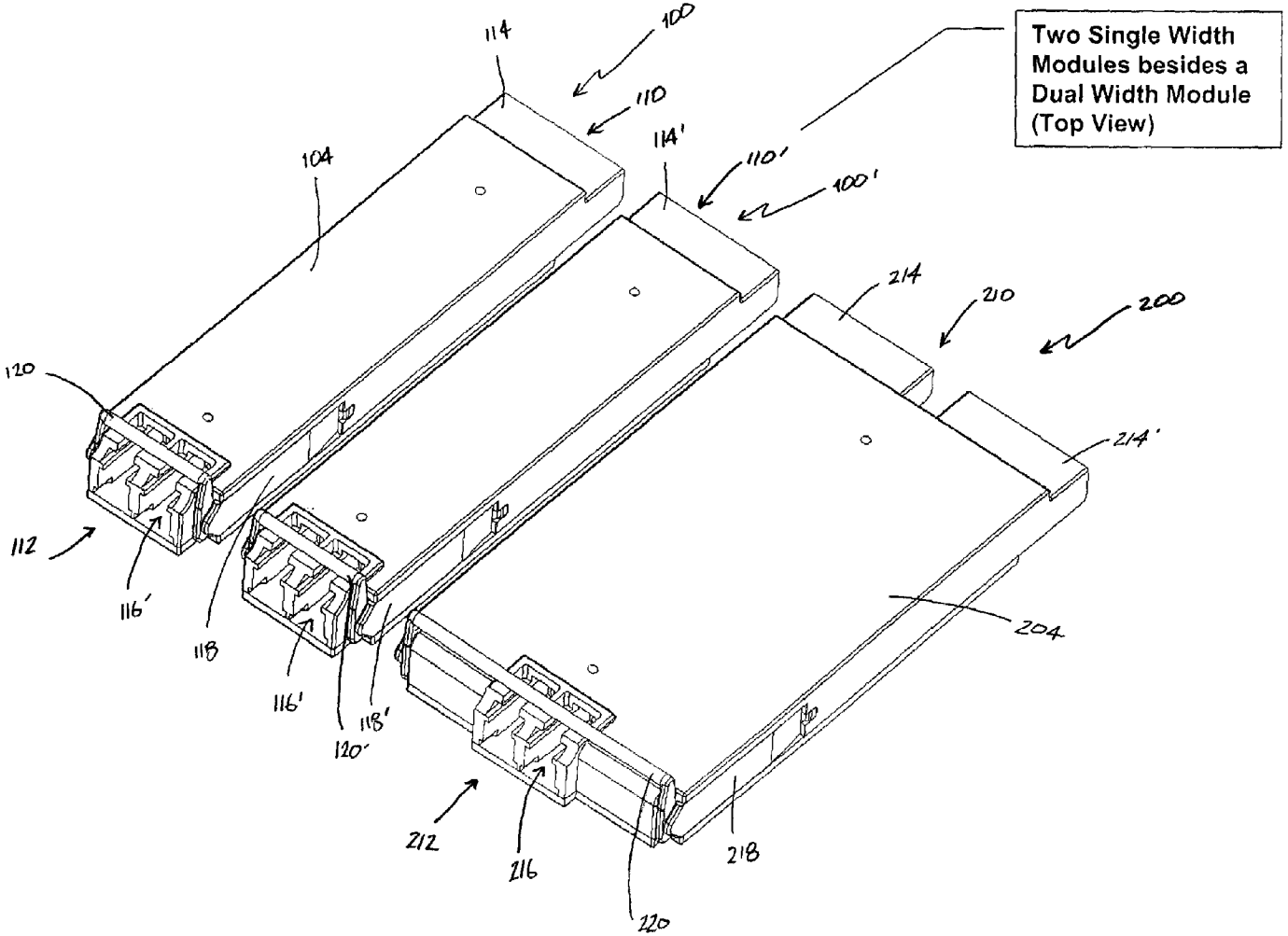
- FIGURE 5 -

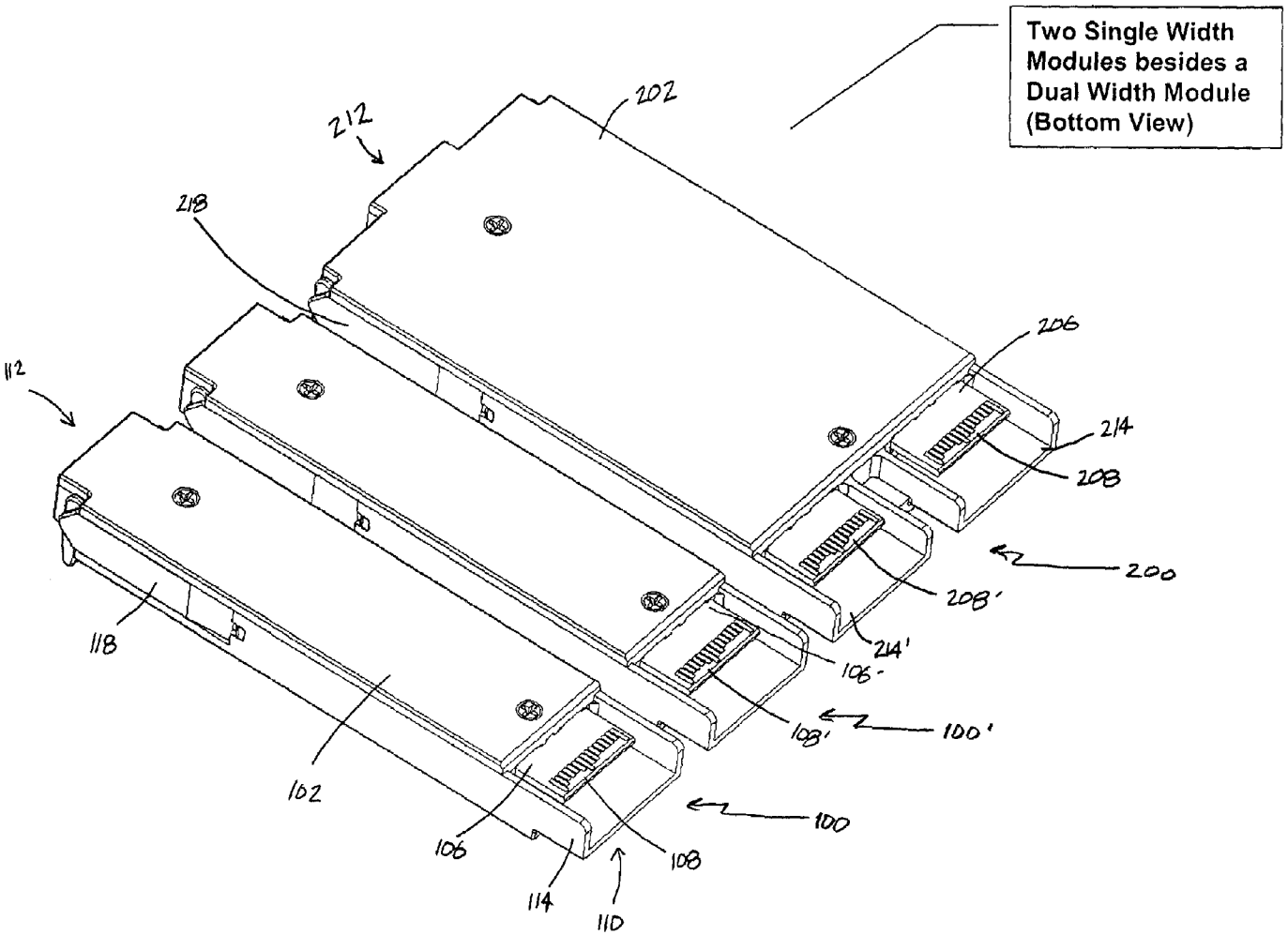
- FIGURE 6 -

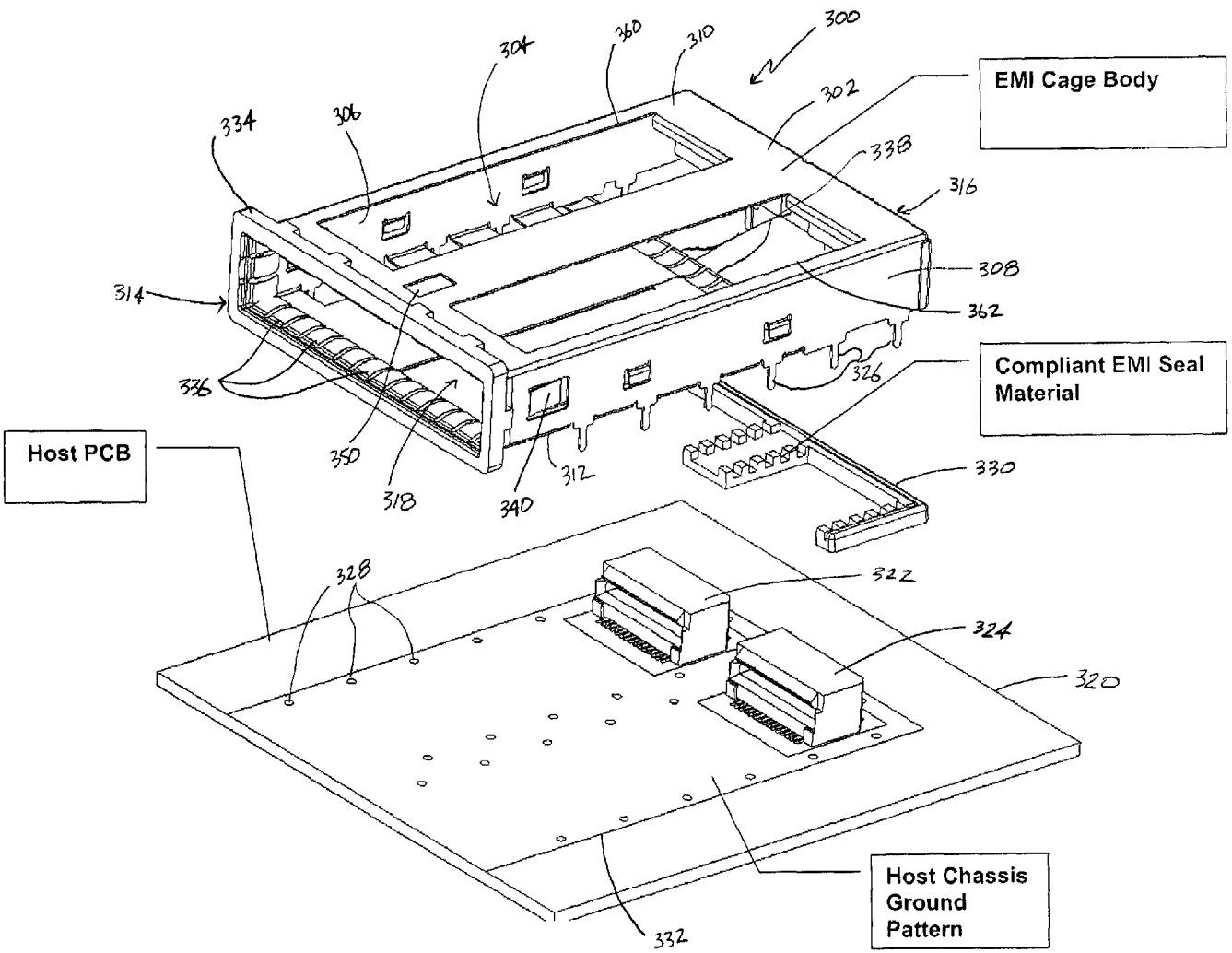
- FIGURE 7 -

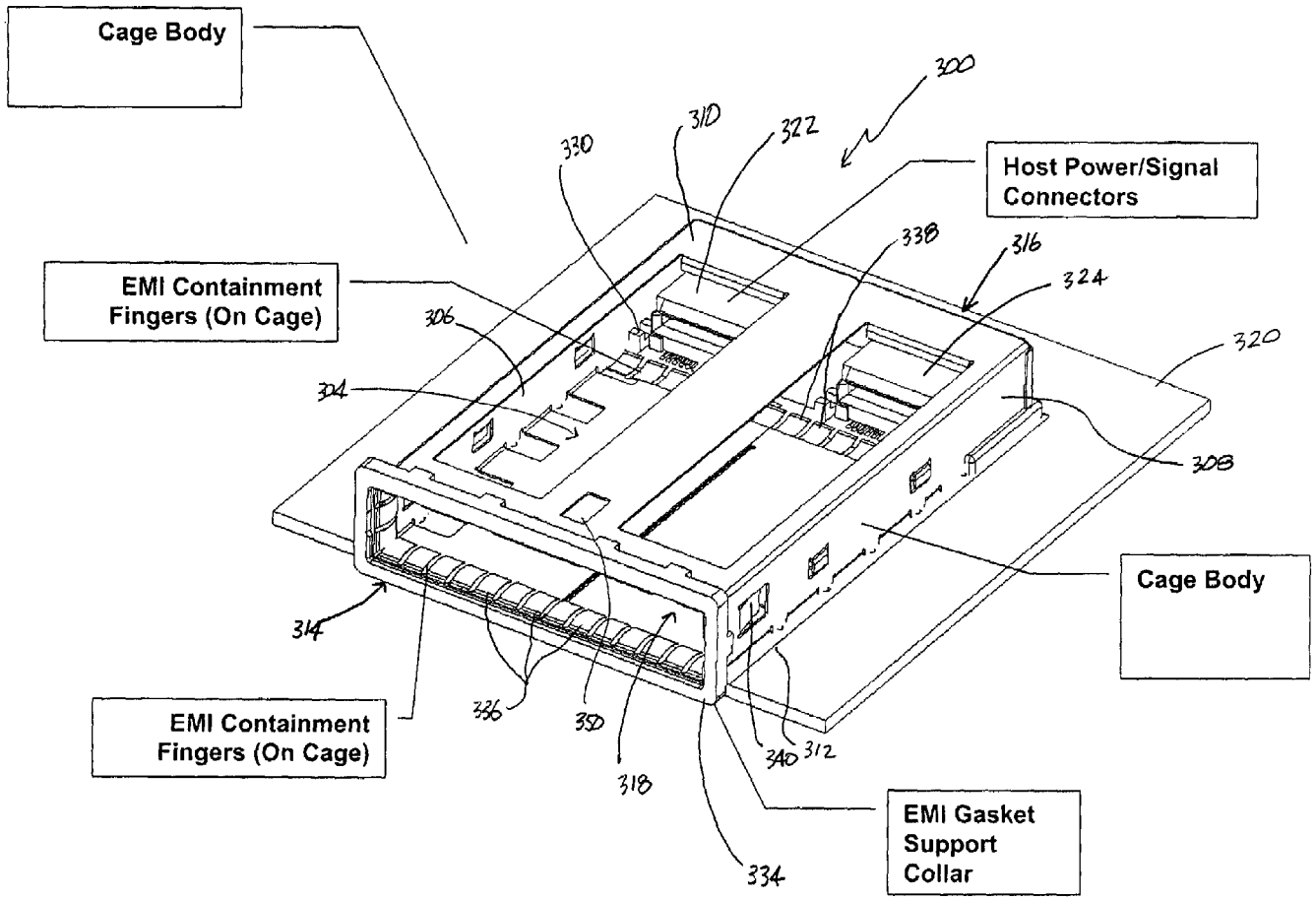
- FIGURE 8 -

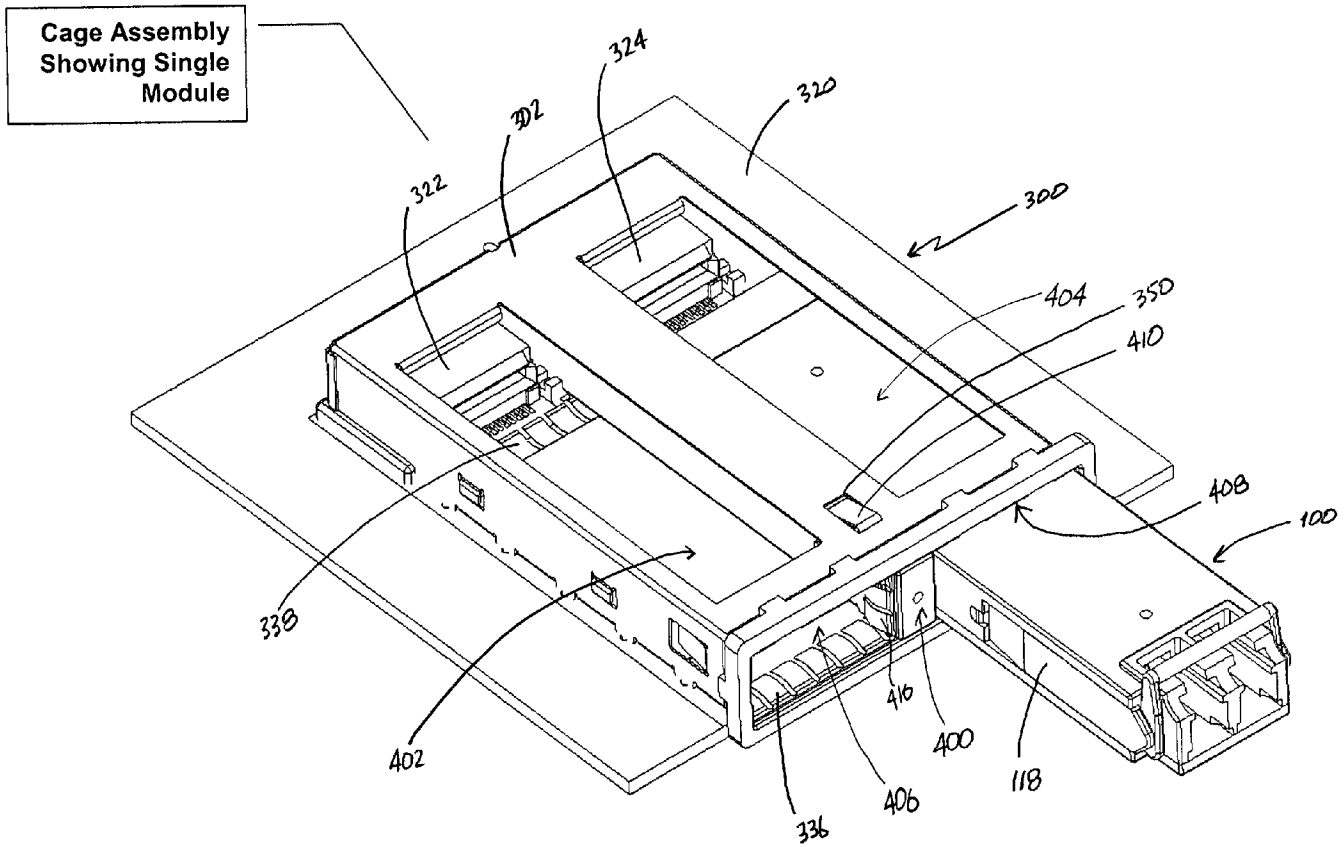
- FIGURE 9 -

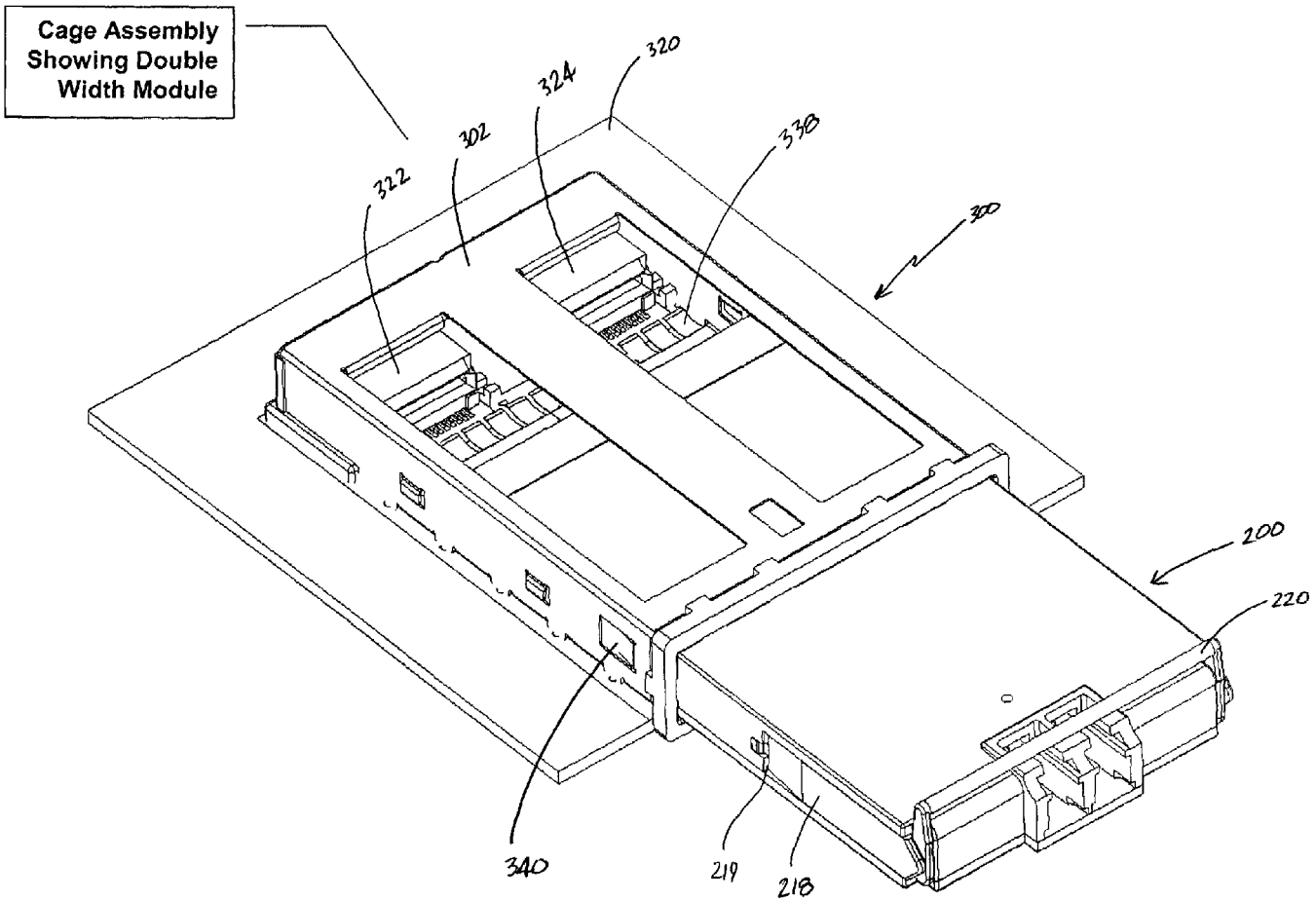
- FIGURE 10 -

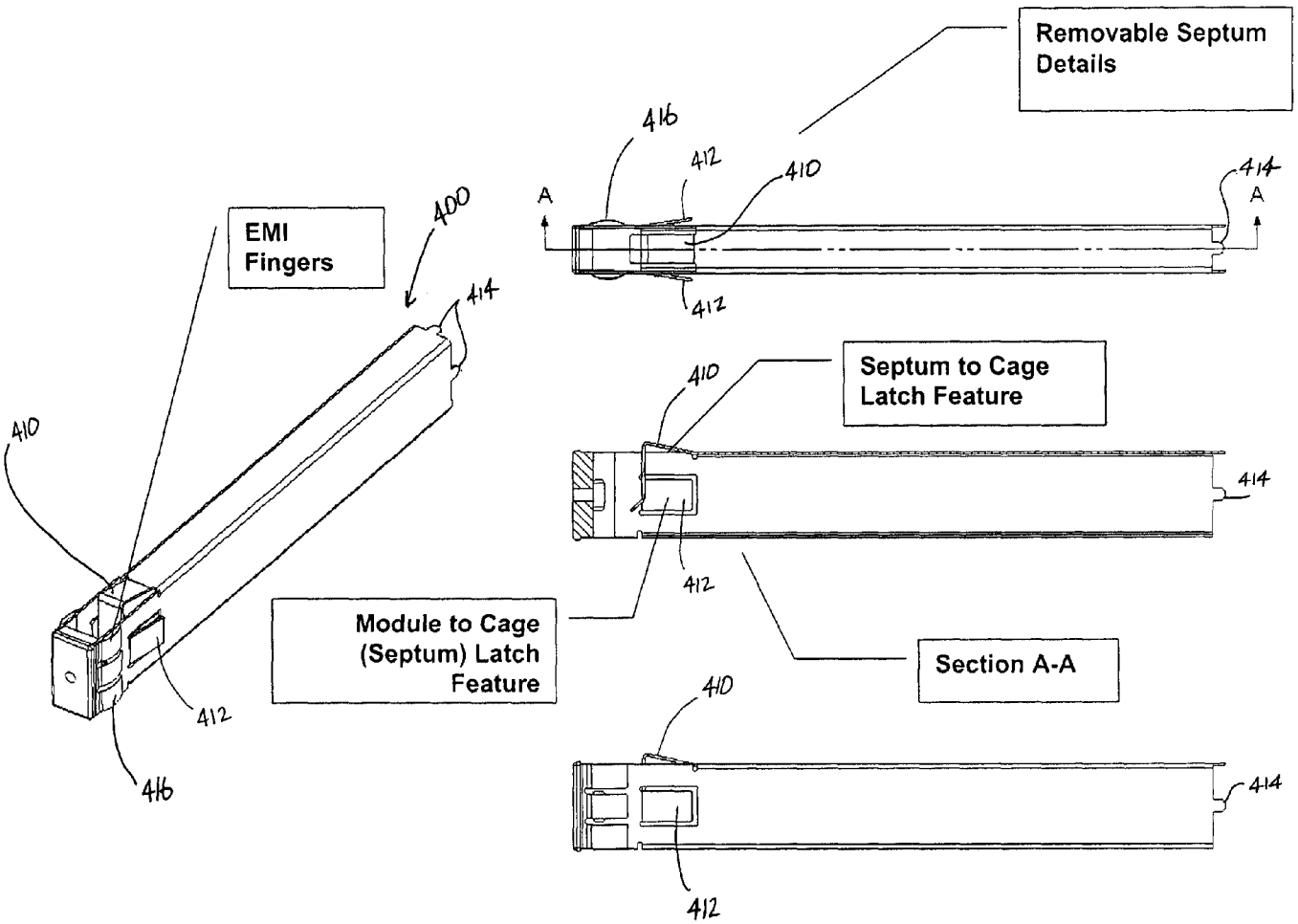
- FIGURE 11 -

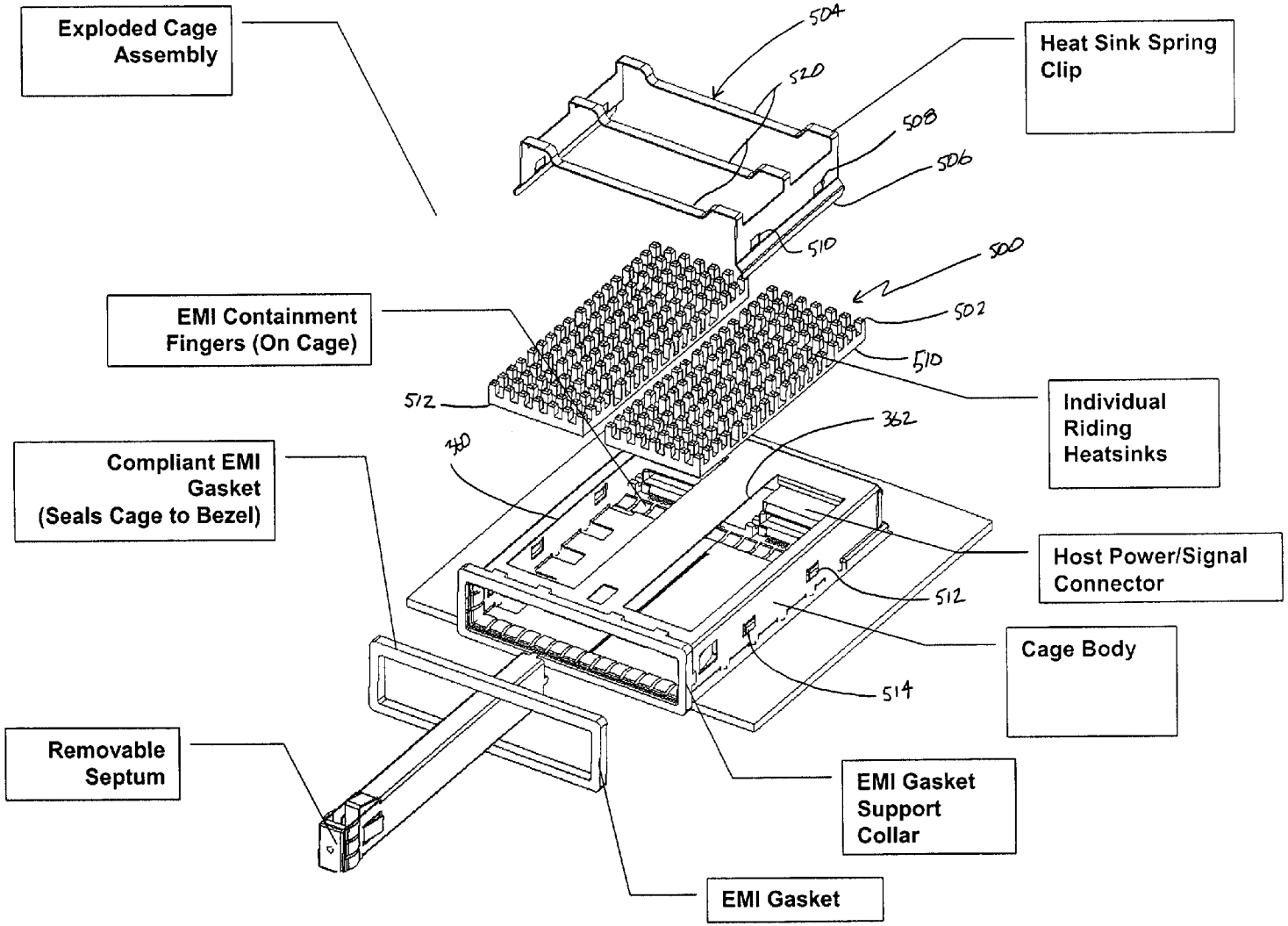
- FIGURE 12 -

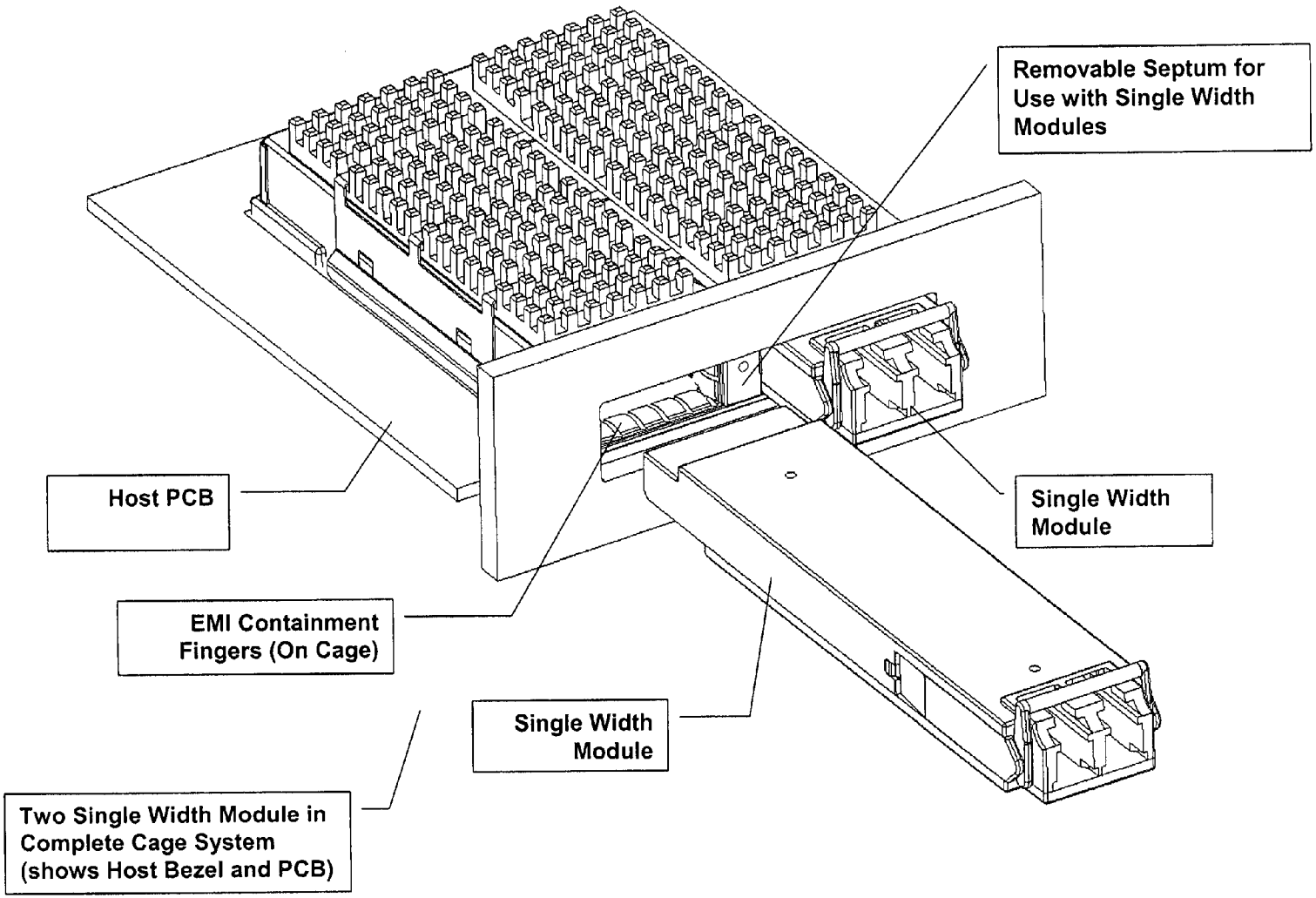
- FIGURE 13 -

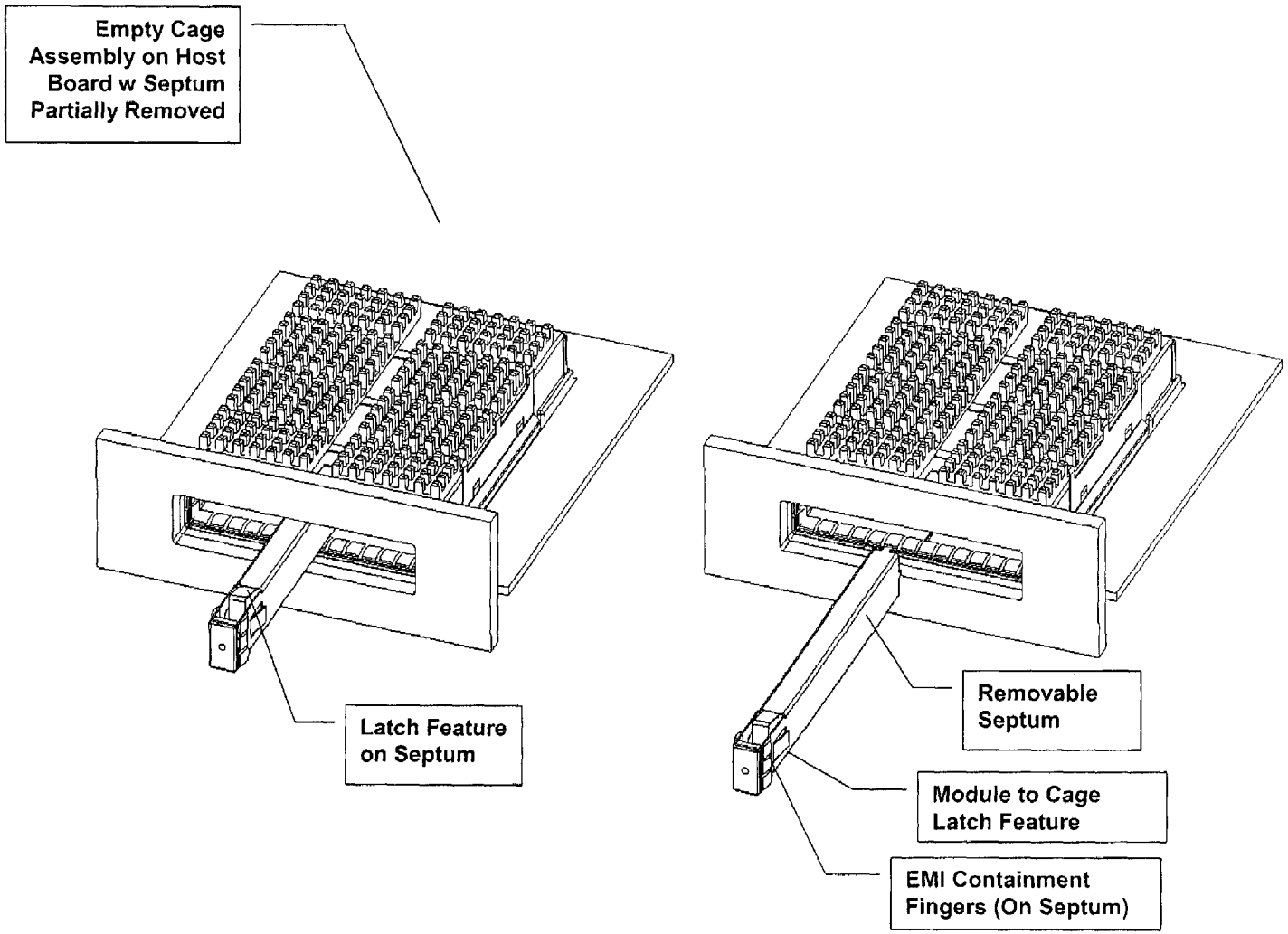
- FIGURE 14 -

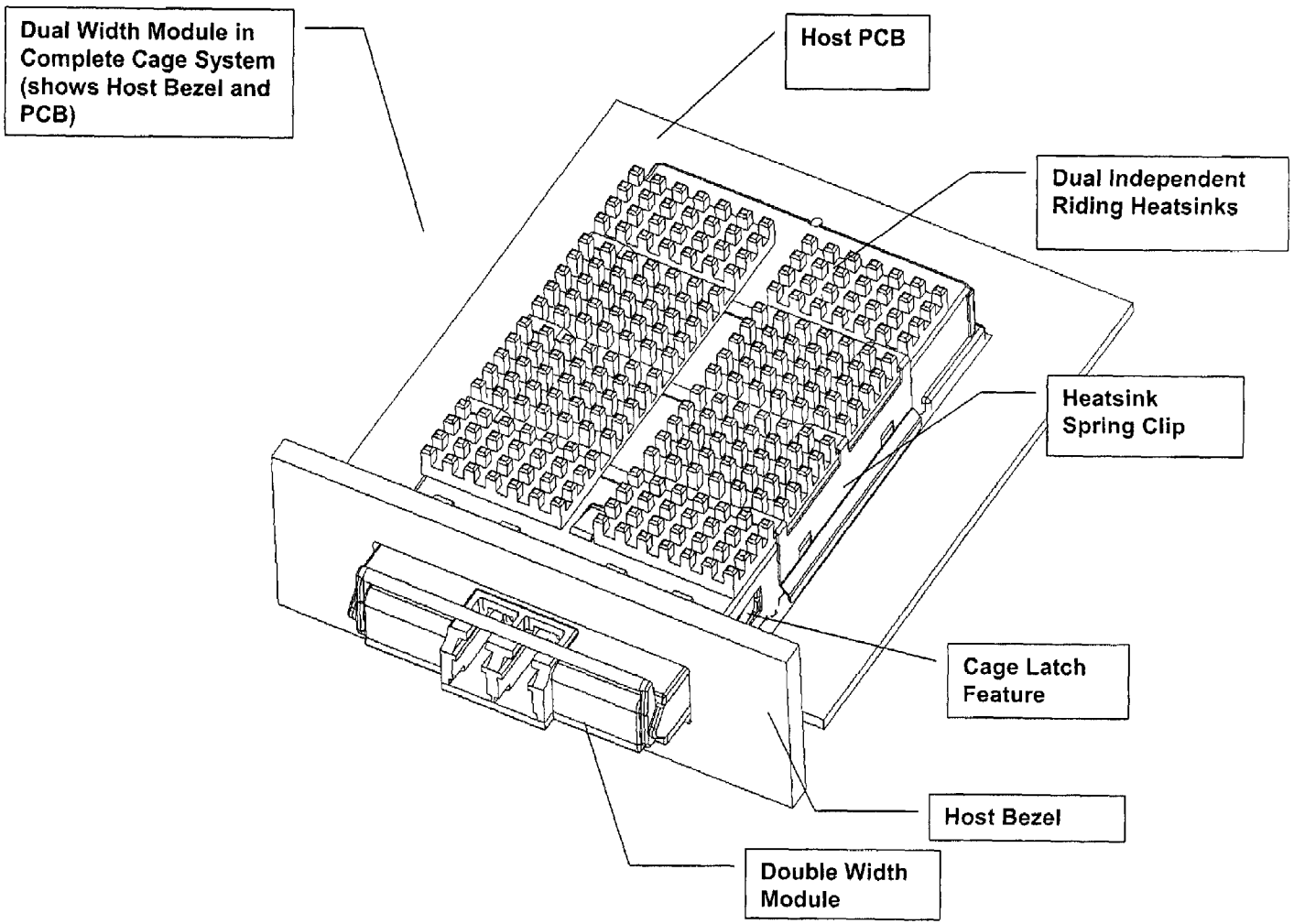
- FIGURE 15 -

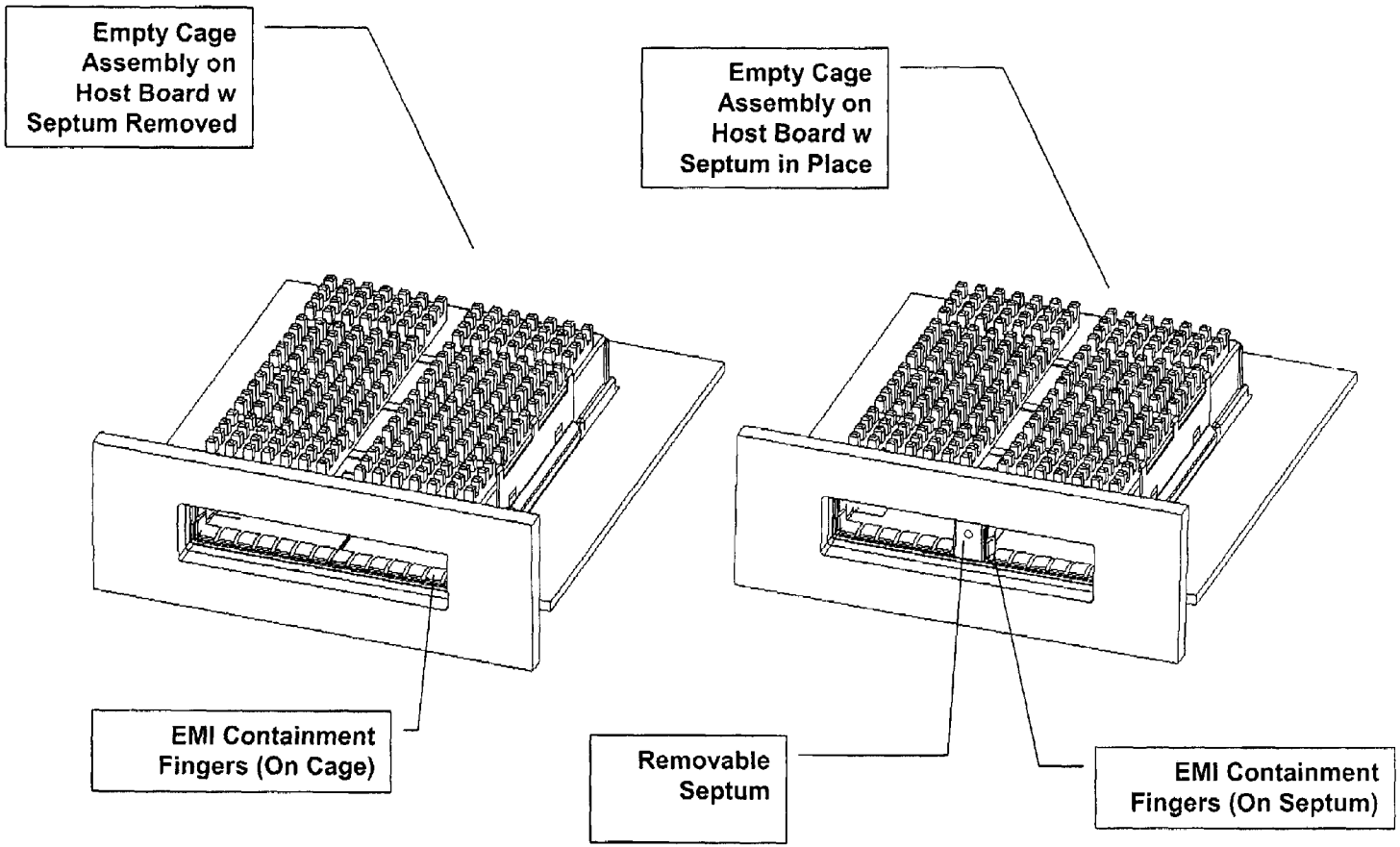
- FIGURE 16 -

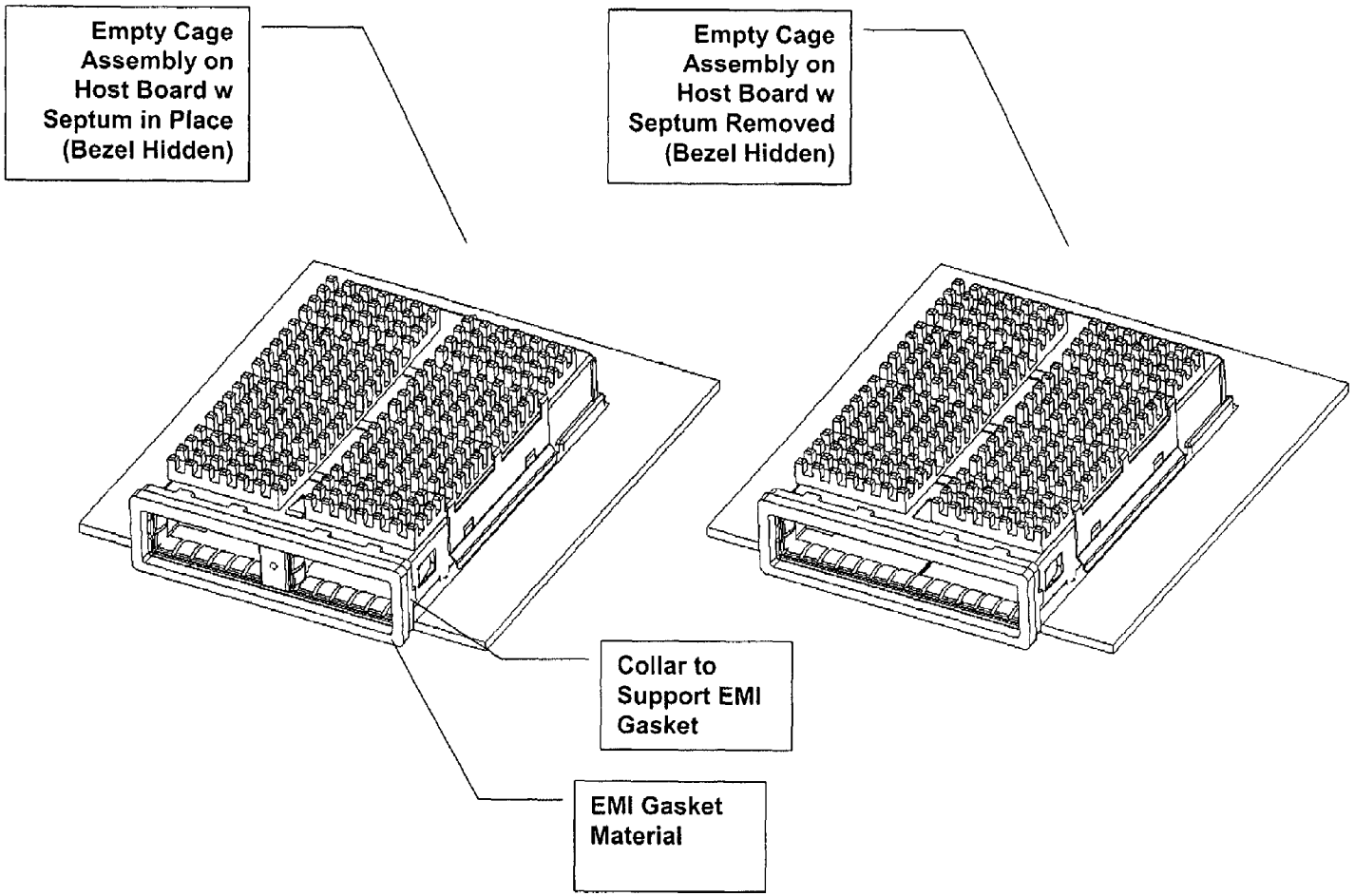
- FIGURE 17 -

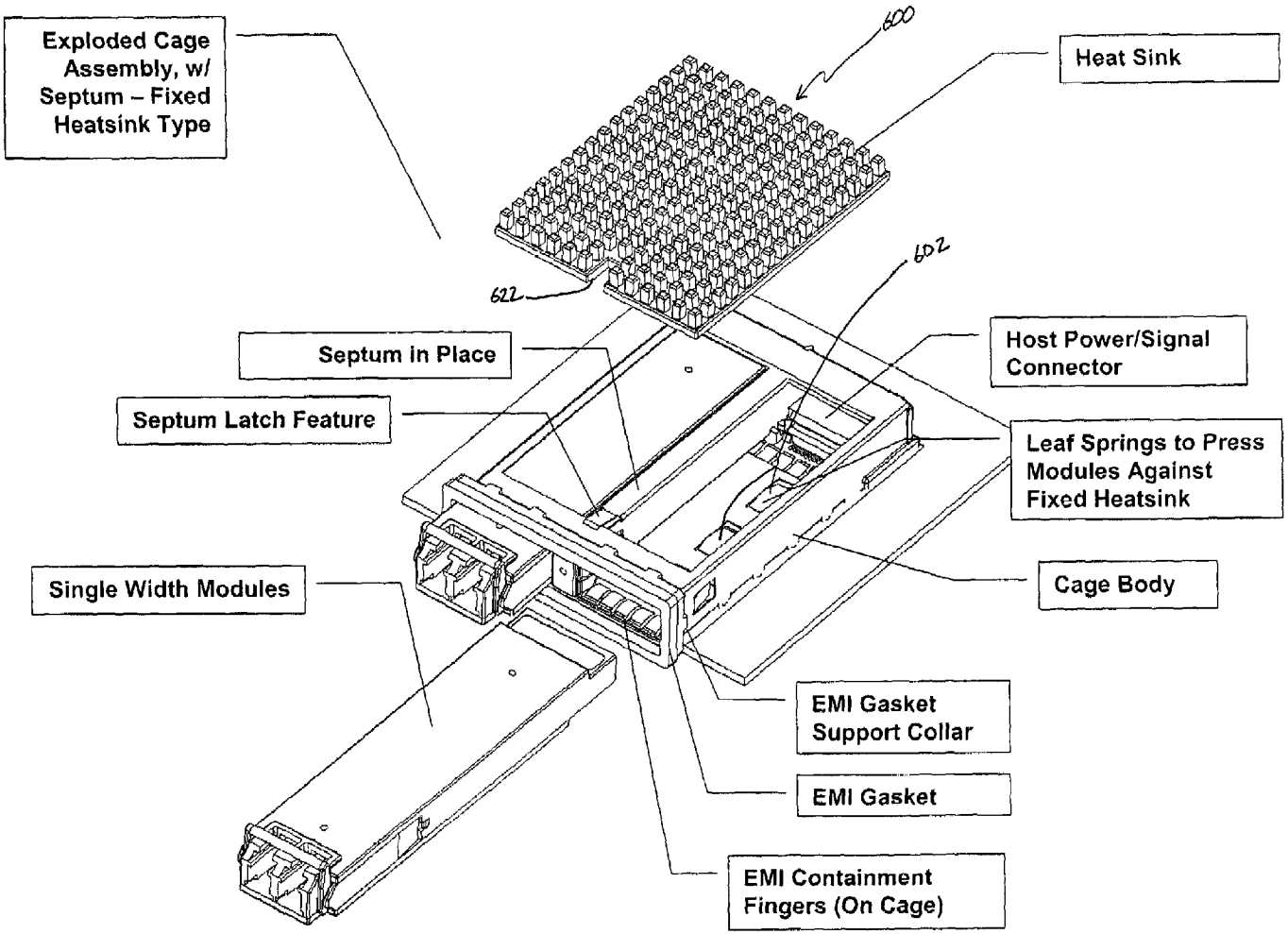
- FIGURE 18 -

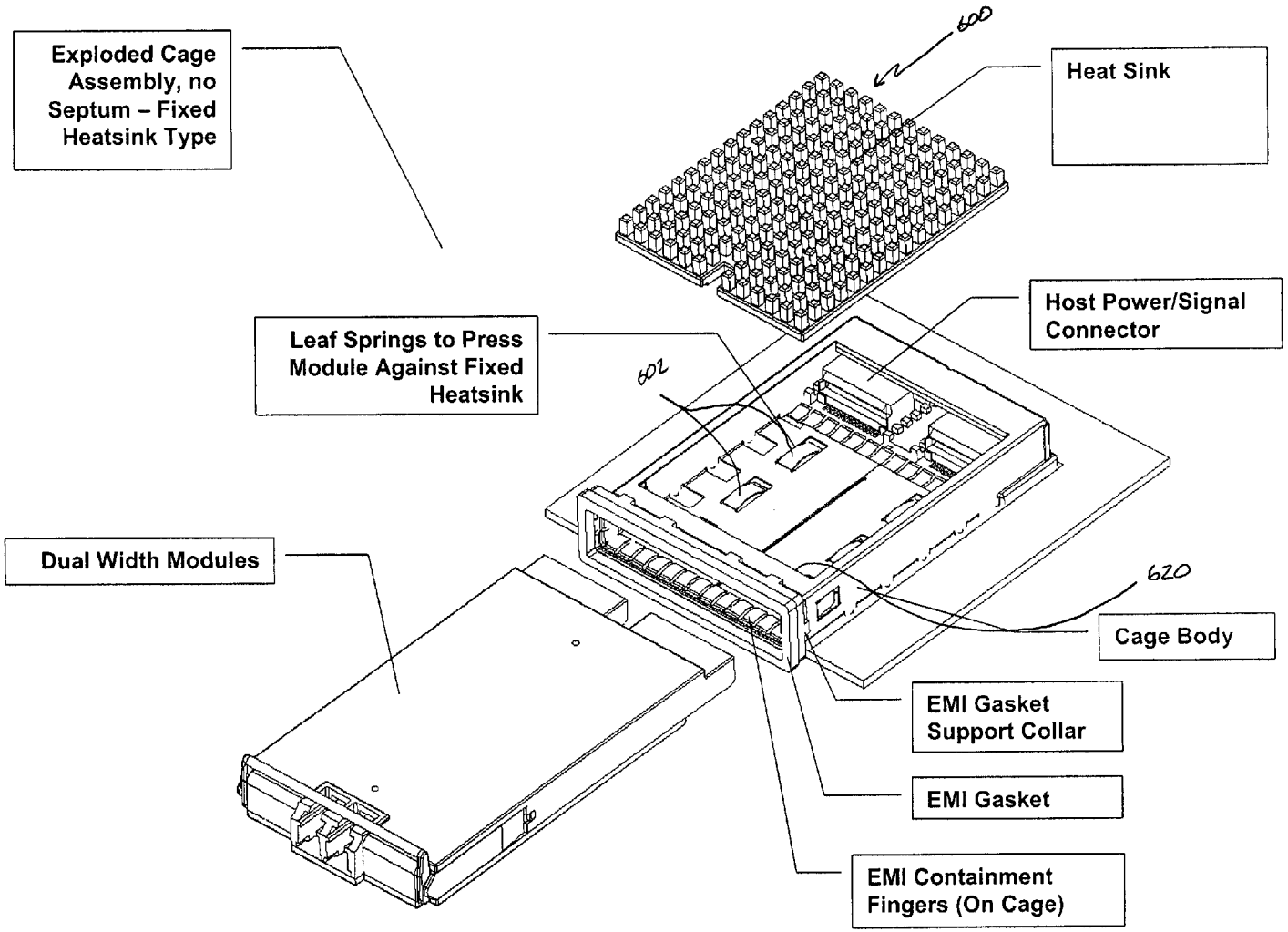
- FIGURE 19 -

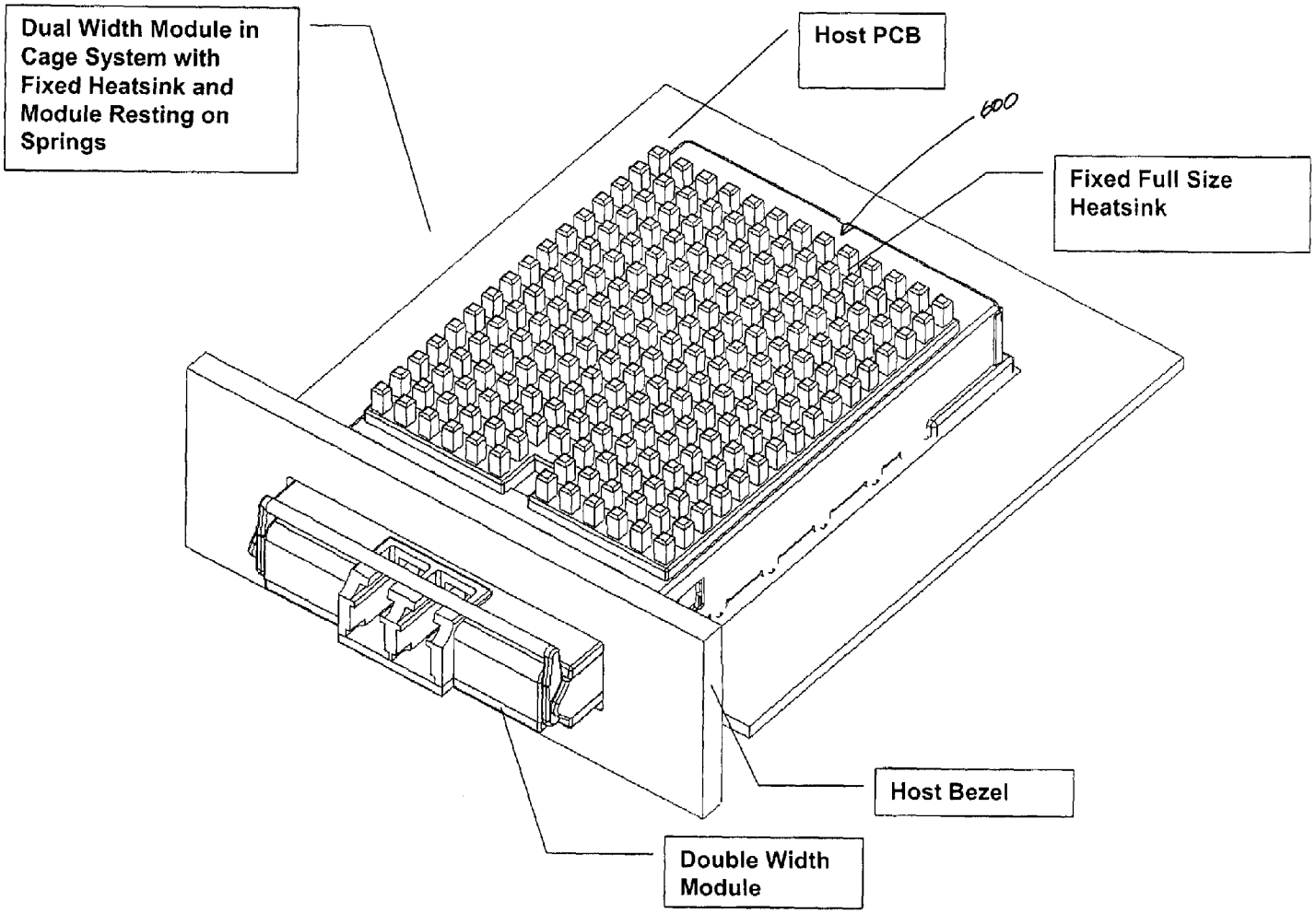
- FIGURE 20 -

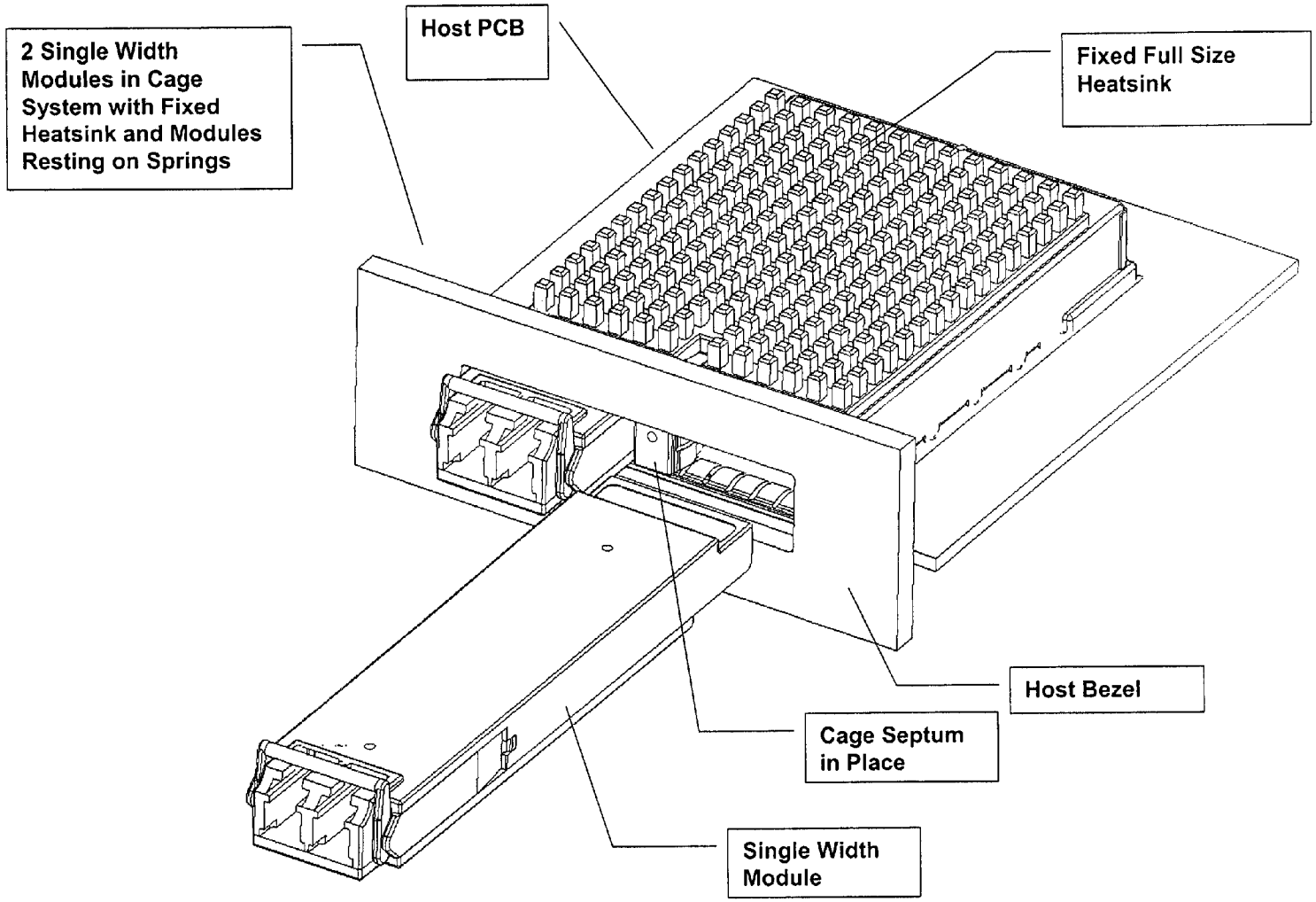
- FIGURE 21 -

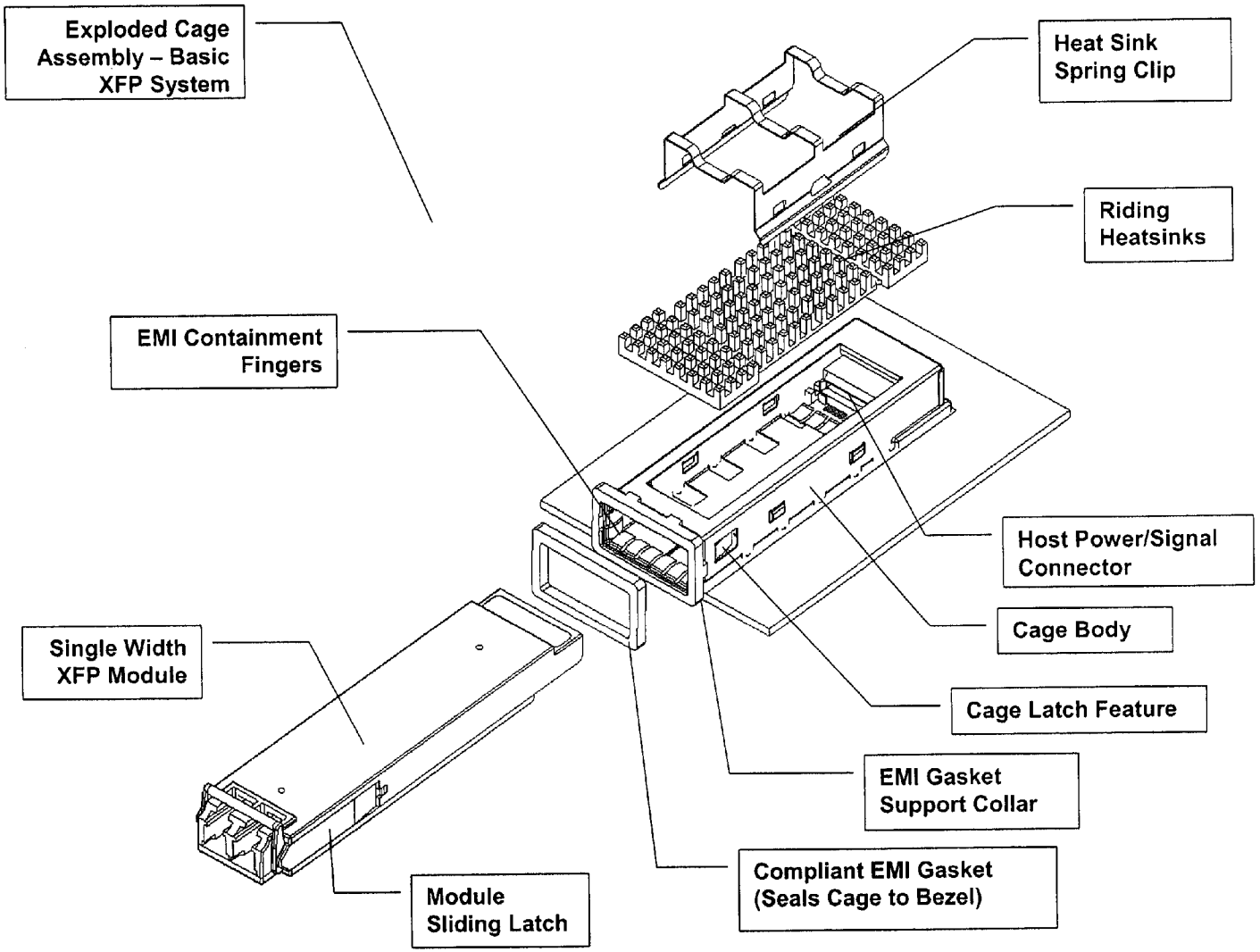
- FIGURE 22 -

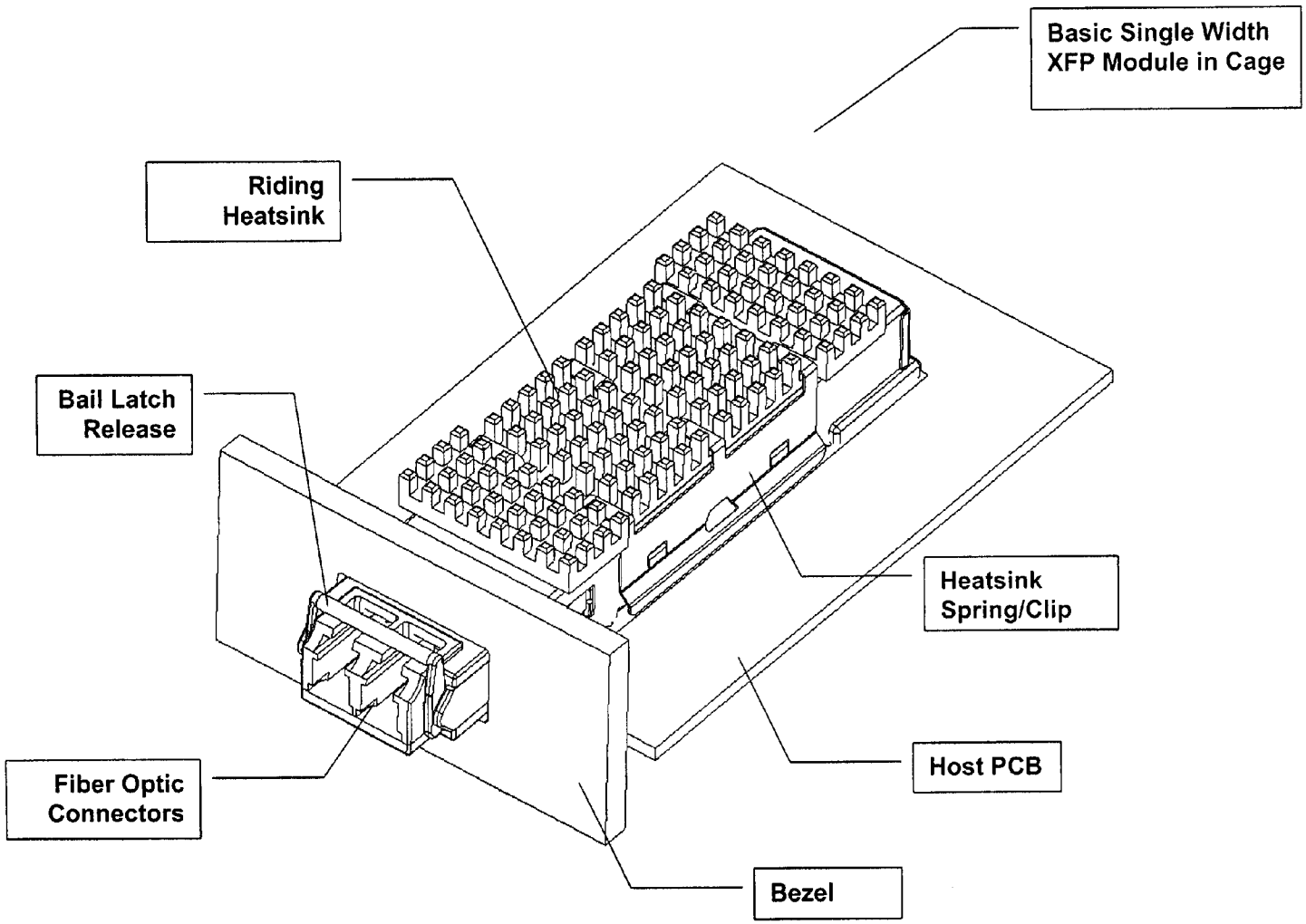
- FIGURE 23 -

TRANSCEIVER MODULE CAGE FOR USE WITH MODULES OF VARYING WIDTHS

CROSS REFERENCE TO RELATED APPLICATIONS

The present application claims priority to and the benefit of U.S. Provisional Patent Application Ser. No. 60/410,858, filed Sep. 14, 2002 and entitled "Transceiver Module Cage for Use With Modules of Varying Widths," which is incorporated herein by reference in its entirety.

BACKGROUND

1. The Field of the Invention

The present invention generally relates to pluggable electrical or optical modules. More particularly, the present invention relates to cage systems that permit pluggable modules of different widths, such as optoelectronic transceiver modules, to be connected to electrical connectors on a host board.

2. The Relevant Technology

Fiber optics are increasingly used for transmitting voice and data signals. As a transmission medium, light provides a number of advantages over traditional electrical communication techniques. For example, light signals allow for extremely high transmission rates and very high bandwidth capabilities. Also, light signals are resistant to electromagnetic interferences that would otherwise interfere with electrical signals. Light also provides a more secure signal because it doesn't allow portions of the signal to escape from the fiber optic cable as can occur with electrical signals in wire-based systems. Light also can be conducted over greater distances without the signal loss typically associated with electrical signals on copper wire.

While optical communications provide a number of advantages, the use of light as a transmission medium presents a number of implementation challenges. In particular, the data carried by light signal must be converted to an electrical format when received by a device, such as a network switch. Conversely, when data is transmitted to the optical network, it must be converted from an electronic signal to a light signal. A number of protocols define the conversion of electrical signals to optical signals and transmission of those optical signals, including the ANSI Fibre Channel (FC) protocol. The FC protocol is typically implemented using a transceiver module at both ends of a fiber optic cable. Each transceiver module typically contains a laser transmitter circuit capable of converting electrical signals to optical signals, and an optical receiver capable of converting received optical signals back into electrical signals.

Typically, a transceiver module is electrically interfaced with a host device—such as a host computer, switching hub, network router, switch box, computer I/O and the like—via a compatible connection port. Moreover, in some applications it is desirable to miniaturize the physical size of the transceiver module to increase the port density, and therefore accommodate a higher number of network connections within a given physical space. In addition, in many applications, it is desirable for the module to be hot-pluggable, which permits the module to be inserted and removed from the host system without removing electrical power. To accomplish many of these objectives, international and industry standards have been adopted that define the physical size and shape of optical transceiver modules to insure compatibility between different manufacturers. For example, in 2000, a group of optical manufacturers developed a set of standards for optical transceiver modules called the Small Form-factor Pluggable ("SFP") Transceiver MultiSource Agreement ("MSA"), incorporated herein by reference. In addition to the details of the electrical interface, this standard defines the physical size and shape for the SFP transceiver modules, and the corresponding host port, so as to insure interoperability between different manufacturers' products. There have been several subsequent standards, and proposals for new standards, including the XFP MSA for 10 Gigabit per second modules using a serial electrical interface, that also define the form factors and connection standards for pluggable optoelectronic modules, such as the published draft version 0.92 (XFP MSA), incorporated herein by reference.

While such standardization efforts provide a number of benefits, including interoperability, high port density, and the like, the standardization on a small form factor device has also resulted in a number of problems. In particular, there is a tradeoff between the desired to maximize the port density, and the need for a form factor large enough to support longer distance fiber optic links.

For example, the proposed physical dimensions of the XFP optoelectronic modules allow for electronic and optical capabilities that provide for transmission distances of approximately 10–20 kilometers. Such transmit distances are typically suitable to transmit data between computers in typically sized local area networks (LANs), storage area networks (SANs), and metropolitan area networks (MANs). However, there is a desire to support greater transmission distances—for example, on the order of 40 to 80 kilometers. Unfortunately, the physical size of the proposed standard modules may limit the ability to meet this objective.

In particular, one factor that limits the distance that an optoelectronic module can transmit a signal is the total power consumption of the module. For example, greater distances may require cooled laser systems, which come at a significant power penalty. However, standards (e.g., the proposed XFP MSA standard) define the physical size of the modules and the available power through the module connector in a manner that may preclude the ability to provide a transmitter that can achieve the greater transmission distances. For example, a module that uses a connector according to the standard has the ability to access at most about 6.5 W, which is divided among three supply voltages and thus may not be completely available for a given design. Consequently, there may be an inability to provide greater transmission distances with existing standard module sizes due to power limitations.

The ability to provide transceivers having greater power requirements is limited in other ways as well. In particular, higher power devices release greater amounts of heat, which must be continuously removed to ensure proper performance or to prevent damage to the device. Again, this is more difficult to do in small form-factor devices. Generally speaking, the ability to remove a given amount of power from a device is tightly coupled to the physical size of that device. Thus, it is relatively more difficult to remove a given amount of power from a smaller device than from a larger one.

While one solution to some of the above problems would be the development of a module having a larger physical form factor, this approach has drawbacks as well. In particular, the larger physical module would be incompatible with existing cage designs used for existing module form factors. Cages are useful for providing structural support for the modules and to (facilitate the insertion and withdrawal of pluggable modules. In higher power designs, the cage usually also incorporates heat sinking features to remove heat from the module. However, conventional cages have a size that does not readily permit the development of newer, longer-distance transceivers, especially for those that will likely require a larger form factor than those that are currently defined according to these standards. Moreover, if cages were to be designed specifically for modules having a larger form factor, then they would in turn be incompatible with existing modules having smaller form factors.

Thus, there is a need in the art for a module, such as an optoelectronic transceiver module, that is able to provide longer transmission distances and/or transmission rates. Preferably, the module would be capable of accommodating electrical and optical components that permit for long distance transmissions. Further, the module design should permit for the satisfactory dissipation of heat so as to prevent damage to the device. In addition, it would be an advancement in the art if the module maintains a low profile, and allows for high port density configurations, and yet has a larger physical width than existing module standards such that it that permits greater flexibility in terms of the amount and types of electrical and optical components that it can accommodate. In addition, it would also be an advancement in the art to provide a card cage system that could be populated with modules having the larger physical width. Preferably, the card cage design would also be able to accommodate modules constructed in accordance with existing standards that have smaller widths. Such a card system should, in addition to providing sufficient structural support to modules, provide sufficient heat dissipation and EMI reduction.

SUMMARY OF EXAMPLE EMBODIMENTS

Illustrated embodiments relate generally to a cage system that is capable of physically receiving electronic pluggable modules, such as opto-electronic transceiver modules used in optical transmission applications, and interfacing them with corresponding electrical connectors positioned on a host printed circuit board. In particular, the exemplary cage system is capable of accommodating pluggable modules that have different physical form factors. According to one presently preferred embodiment, a single cage is capable of being used with modules having different widths. For example, a single cage constructed according to the invention can be used with two "single wide" modules, or alternatively, it can accommodate a single "double wide" module.

An example of an electronic module is formed as a small form-factor pluggable 10 gigabit ("XFP") device in accordance with proposed industry standards. The module includes a base portion that supports a printed circuit board (PCB) upon which is disposed the electronics needed for the functionality of the module. In addition, the PCB has an edge connector formed at one end that is exposed through one end of the module housing so as to be capable of electrically interfacing with a corresponding connector when, for example, the module is operatively received within a port formed within a host cage. Disposed on another end of the base portion is at least one receptacle capable of physically receiving and interfacing with a corresponding optical fiber connector, which in turn is connected to a fiber optic cable. In an example embodiment, an outer housing encloses at least a portion of the base and the PCB to protect the electronic and optical components from dust and the like. Moreover, the housing defines an outer periphery that conforms in size and shape to specifications defined by the MSA standard. This particular size and shape is referred to as "single width" module. In another example, the module may alternatively be configured as a "dual" or "double" width module (also referred to as a double wide module). This dual width configuration has the same length and height as the single width module; however, it is approximately twice the width. Like the single width module, the double width module includes a base portion that supports at least one internal printed circuit board (PCB) upon which is disposed the electronics needed for the functionality of the module. In this configuration however, the PCB (or PCBs) has two edge connectors formed at one end that are both exposed through one end of the dual width module housing. Like the single width version, each edge connector is positioned so as to be capable of electrically interfacing with a corresponding connector when, for example, the module is operatively received within a port formed within a host cage. The opposite end of the dual width module includes a receptacle, similar to that of the single width module, for interfacing with an optical fiber connector.

It will be appreciated that the dual width module configuration provides several distinct advantages. First, its larger size permits accommodation of a larger number, or larger sizes, of electrical and/or optical components. This permits for the use of the type of components that allow, for example, transmission of long distance signals. Moreover, since the dual width configuration provides two edge connectors, the extra connector can be used to obtain additional power and/or ground signal access that is not otherwise available to a single edge connector under existing standards. Finally, the larger top surface area allows the extraction of significantly more heat from the module than in the case of the smaller form factor.

Preferably, the example cage system is implemented to provide several general functions. First, it is capable of providing structural support to a module with respect to a host PCB and host board connector. In addition, the cage system preferably provides means for efficiently and effectively dissipating heat that is released from the modules during operation. This insures that modules do not overheat. The cage system also preferably includes means for minimizing the amount of electromagnetic interference (EMI) that is released by operating modules. Moreover, the cage system is preferably implemented in a manner such that it is able to operably interface with modules that conform to proposed industry standards, such as the MSA, which correspond to single width modules. Also, the cage system can be selectively adapted so that it can also accommodate modules that do not currently conform to existing standards, e.g., the disclosed double width modules.

In one example embodiment, the cage includes a cage body that forms an outer housing having an interior chamber portion. The housing has sidewalls, top and bottom surfaces, and first and second ends. In an illustrated embodiment, the first, or front end of the cage body has a module access port, or opening, formed through the housing so as to provide access to the interior chamber portion of the cage body.

The bottom of the example cage housing is configured so as to be mounted on a top surface of a host printed circuit board (PCB). In addition, two or more host board connectors are mounted on the top surface of the host board at a point adjacent to the second, or rear end of the cage body. In general, these host board connectors are oriented on the host board so as to be capable of physically receiving and electrically interfacing with a corresponding edge connector of a transceiver module when the module is operatively received within a port of the cage.

In this particular configuration, the size and shape of the port and the interior chamber is defined so as to be capable of physically receiving and accommodating a dual width pluggable module. Moreover, when operably received through the port and retained within the chamber, each of the edge connectors of the dual width module are electrically and physically interfaced with separate host board connectors.

Alternatively, a cage system can be implemented with means for selectively configuring the module port and chamber so as to be capable of accepting multiple pluggable modules having physical dimensions different from that of the dual width module. In one illustrated example, one or more removable "septums" are used to configure the cage to be used with pluggable modules of different widths. Thus, the chamber, and the access port to the chamber, can be subdivided into two laterally displaced chambers when the septum is positioned within the access port and chamber. The septum, when thus positioned in the port and chamber, provides a dividing wall that now effectively subdivides the single chamber into two laterally displaced module subchambers. Each of these subchambers has an associated host board connector, and can now be used with a single wide module. In addition, the septum is preferably configured to be removable through the front panel of the host system so that the system may be converted to the larger form factor without opening the chassis of the host system.

The septum can be removed through the access port opening defined by the cage body. The septums are removable in the sense that the end user can remove or reinsert the septums into the cage body to switch the configuration of the cages between the single-wide configuration and the double-wide configuration. In a preferred embodiment, the septum includes a latching mechanism that secures the septum within the cage chamber, and which can be disengaged by the user when the septum is removed. In addition, in preferred embodiments, the septums are equipped with a latching mechanism that engages a corresponding latch formed on the single-wide modules and that can be manually released so as to disengage the modules when removed by a user.

It will be appreciated that larger cage assemblies with more than one septum could accommodate more than two standard size modules as well as being able to accommodate modules which are even larger than the double width module described herein.

In another example, the top surface of the cage housing includes at least one heat sink opening. This opening accommodates a heat sink structure that is retained in a manner so as to remove heat from the modules when disposed within the chamber.

In preferred embodiments, the cage assembly is also equipped with means for reducing the emission of electromagnetic interference (EMI). In one example embodiment, this is at least partially implemented via a plurality of conductive "fingers" oriented about the inner periphery of the port opening and at a rear portion of the chamber. These EMI containment fingers are resilient so as to maintain electrical contact with the outer housing of the module when it is operatively received within the cage. Moreover, they are configured so as to maintain an electrical connection to a chassis ground point, such as a host chassis ground pattern formed on the host printed circuit board. In addition, the corresponding outer periphery of the removable septum is also preferably equipped with similar conductive fingers, so as to insure proper EMI containment when the cage chamber is subdivided in to multiple module receiving chambers.

The foregoing, together with other features and advantages of the present invention, will become more apparent when referred to the following specification, claims and accompanying drawings.

BRIEF DESCRIPTION OF THE DRAWINGS

In order that the manner in which the above-recited and other advantages and features of the invention are obtained, a more particular description of embodiments of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which:

FIG. 2 is a perspective view of one example of a "single width" electronic module that is used in embodiments of the present invention;

FIGS. 3 and 4 are perspective views of one example of a "double" or "dual" width electronic module that is used in embodiments of the present invention;

FIGS. 5 and 6 are perspective views of the modules of FIGS. 1–4;

FIG. 7 is an exploded perspective view of one example of a cage system that is used in embodiments of the present invention;

FIG. 8 is a perspective view of the cage system of FIG. 7;

FIG. 9 is a perspective view of a cage system having an electronic module partially disposed therein;

FIG. 10 is a perspective view of another cage system having an electronic module partially disposed therein;

FIG. 11 is a perspective, side and top view of a septum used in embodiments of the present invention;

FIG. 12 is an exploded perspective view of yet another example of a cage system assembly;

FIG. 13 is a perspective view of another example of a cage system and electronic module oriented for receipt within the cage;

FIG. 14 is a perspective view of an exemplary cage system and septum configuration;

FIG. 15 is a perspective view of a cage system having an electronic module operatively disposed therein;

FIG. 16 is a perspective view of an exemplarily cage system;

FIG. 17 is a perspective view of yet another embodiment of an example cage;

FIG. 18 is an exploded perspective view of an example cage system and electronic module;

FIG. 19 is an exploded perspective view of yet another cage system and electronic module;

FIG. 20 is a perspective view of a cage system having an electronic module operatively disposed therein;

FIG. 21 is a perspective view of a cage system and electronic module;

FIG. 22 is an exploded perspective view of yet another cage system and electronic module; and FIG. 23 is a perspective view of the cage system of FIG. 22 having the electronic module operatively received therein.

DETAILED DESCRIPTION OF EXAMPLE EMBODIMENTS

Figure 4:
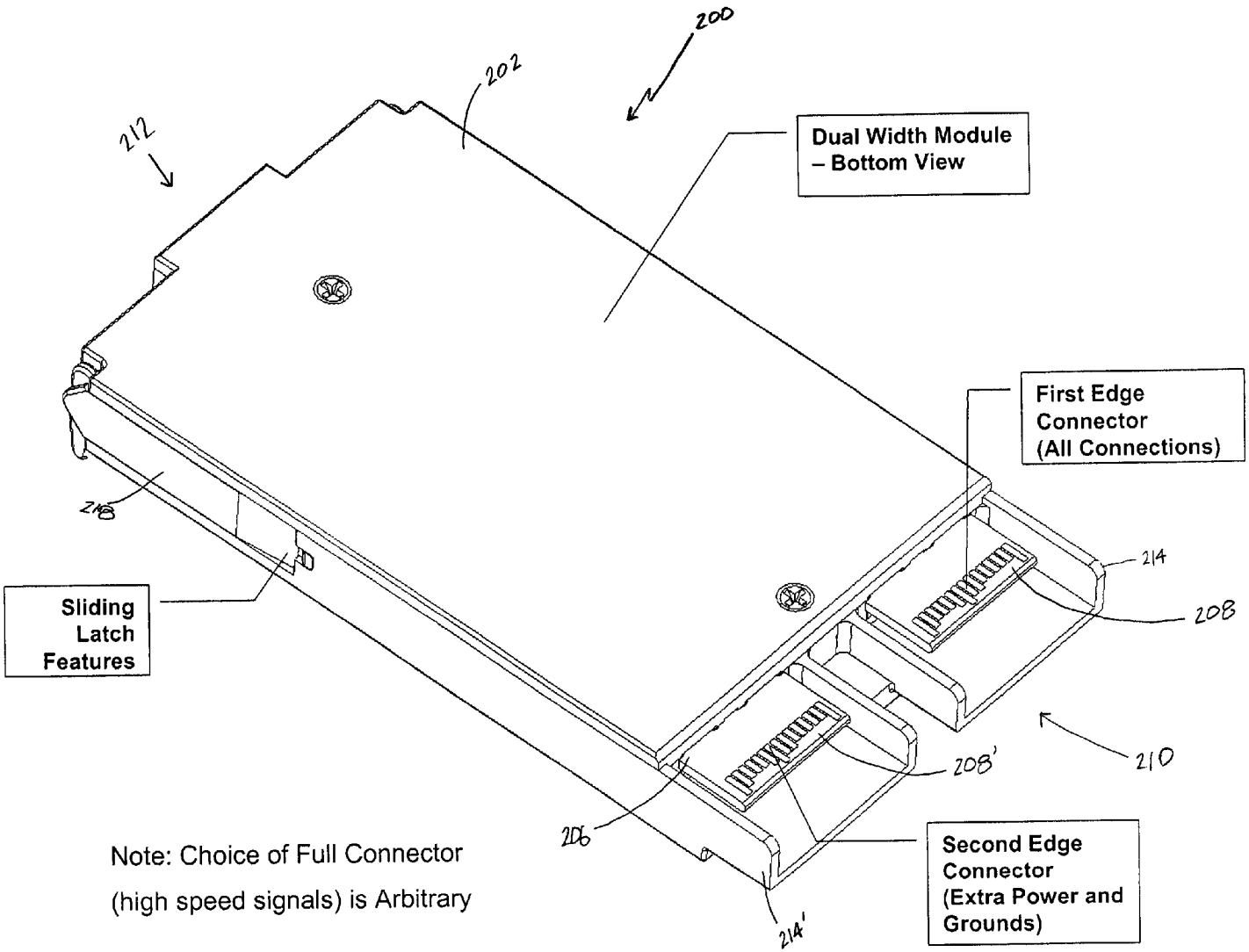

Reference will now be made to the drawings to describe presently preferred embodiments of the invention. It is to be understood that the drawings are diagrammatic and schematic representations of the presently preferred embodiments, and are not limiting of the present invention, nor are they necessarily drawn to scale.

In general, the present invention relates to a cage system that is capable of physically receiving electronic pluggable modules. In one example, the pluggable modules are implemented as opto-electronic transceiver modules that would be used in optical transmission applications. In addition to physically supporting the modules, the cage system retains them in a manner so that they can be interfaced with corresponding electrical connectors that are positioned on a host printed circuit board.

Embodiments of the cage system are uniquely configured so as to permit the accommodation of pluggable modules that have different form factors. According to one example embodiment, a single cage is capable of being used with modules having different widths. For example, a single cage can be used with a single wide module, or alternatively, it can be easily configured to accommodate a double wide module. Of course, while for purposes of convenience example embodiments are illustrated with single and double wide modules, as will be seen, the same principles could be applied so as to provide a cages system that can accommodate any one of a number of alternate form factors (widths, heights, etc.).

Reference is first made to FIGS. 2–6, which together illustrate examples of the types of pluggable modules that can be used with one example embodiment of the cage system. In general, FIG. 2 is an illustrations of a "single width" electronic module, which is formed as a small form-factor pluggable ("SFP") device in accordance with existing industry standards (MSA). The module includes a base portion 102 that supports a printed circuit board (PCB) 106 upon which is disposed the electronics needed for the functionality of the module. The printed circuit board 106 and base portion 102 are enclosed by a generally rectangular outer housing 104. In addition, the PCB has an edge connector 108 (FIG. 2) that is formed at one end of the PCB and that is exposed through a rear end 110 of the module housing that is formed as a connector skirt 114. Disposed on another front end 112 of the base portion is at least one receptacle 116 that is capable of physically receiving and interfacing with a corresponding optical fiber connector (not shown), which in turn is connected to a fiber optic cable (not shown).

In the illustrated example, the module 100 is further equipped with a latching mechanism 118 formed along at least one side of the module housing. The latching mechanism is actuated via movement of a bail lever 120. Thus, when inserted within a complementary port, the latch mechanism engages a corresponding latch on the port thereby securing the module within the port. To release the latch, the user actuates the bail lever 120, which causes the latching mechanism to disengage from the port latch. It will be appreciated that any one of a number of different latching mechanisms could be used here. One presently preferred embodiment of an appropriate latching mechanism is disclosed in co-pending provisional patent application having Ser. No. 60/419,156 filed on Oct. 16, 2002 and entitled "XFP Transceiver Bail." That application is incorporated herein by reference in its entirety.

In the exemplary embodiment, the module 100 defines an outer periphery that conforms in size and shape to specifications defined by the MSA standard. Again, this particular size and shape is referred to herein as "single width" module. Further details regarding exemplary module details can be found in the MSA specification, and in U.S. Pat. No. 6,439,918, in co-pending U.S. patent application Ser. No. 10/036,995, filed Oct. 22, 2001, and the above noted application No. 60/419,156, each of which are incorporated herein by reference.

In presently preferred embodiments, the module may alternatively be configured with a different form factor. In the example embodiment, it is configured as a "dual" or "double" width module (also referred to as a double wide module) 200, as is illustrated in FIGS. 3 and 4. As is shown, in this particular example the dual width configuration has substantially the same length and height as the single width module; however, it is approximately twice the width. Like the single width module, the double width module 200 includes a base portion 202 that supports at least one internal printed circuit board (PCB) 206 upon which is disposed the electronics needed for the functionality of the module. In this configuration however, the PCB (or PCBs) has two edge connectors 208 and 208' (FIG. 4) formed at one end that are both exposed through one end 210 of the dual width module housing 204 and the corresponding connector skirt 214, 214'. Like the single width version, each edge connector 208, 208' is positioned so as to be capable of electrically interfacing with a corresponding connector when, for example, the module is operatively received within a port formed within a host cage (described further below). In this way, for example, one of the connectors can be used in accordance with the standard (i.e., power, ground and signals via assigned pins). However, the other connector can utilize only the power and ground pins, thereby providing the module with twice the electrical power than what would otherwise be available. As noted, this may be especially useful in modules providing long distance transmission capabilities and/or extremely high transmission rates (e.g., that may require higher power requirements). The opposite end 212 of the dual width module includes a receptacle 216, similar to that of the single width module, for interfacing with an optical fiber connector (not shown). Again, additional details regarding a dual width module can be found in the previously mentioned U.S. patent application Ser. No. 10/036,995.

FIGS. 5 and 6 illustrate perspective views of two single width modules 100, 100' in a side-by-side orientation with a dual width module 200. As can be seen here, the length and height of the modules is substantially equal. However, the width of the dual width module is approximately twice that of the single width modules. More precisely, in the illustrated embodiment the width of the dual width module 200 is sufficient to provide a predetermined spacing between its two edge connectors 208 and 208' (FIG. 6). In particular, existing standards specify that the connectors positioned on host connector boards be separated so that there is 23.5 mm between connector centers (23.5 mm pitch). Thus, in the illustrated embodiment the width of the dual width module is such so that the two edge connectors 208 and 208' could be simultaneously received within two host board connectors, e.g., approximately 23.5 mm between centers. Of course, this distance could be varied depending on the particular application environment.

Reference is next made to FIGS. 7 and 8 which together illustrate one example of a cage system, designated generally at 300. The cage system includes a cage body 302 that forms an outer housing having an interior chamber portion 304. The housing body 302 has sidewalls 306 and 308, top 310 and bottom 312 surfaces, and first 314 and second 316 ends. In the illustrated example, the first 314, or front end of the cage body 302 has a module access port, or opening 318, formed through the housing body 302 so as to provide access to the interior chamber portion 304 of the cage body 302.

The bottom 312 of the cage housing 302 is configured so as to be mounted on a top surface of a host printed circuit board (PCB) 320. In addition, two or more host board connectors 322 and 324 are mounted on the top surface of the host board 320 at a point adjacent to the second 316, or rear end of the cage body 302 when the cage is mounted on the host board 320. In general, these host board connectors are oriented on the host board so as to be capable of physically receiving and electrically interfacing with a corresponding edge connector (e.g., 108, 208 described above) of a transceiver module when the module is operatively received within a port of the cage.

While any one of a number of different mounting techniques could be used, in the illustrated embodiment the cage body 302 is press fit on the surface of the host board 320. This is facilitated by a number of mounting posts 326 formed along the side walls 306, 308 of the cage body 302. When mounted on the board 320, these posts 326 are received within corresponding receiving holes 328 formed in the top surface of the board 320. The sizes and shapes of the posts and holes are such so as to provide a tight and rigid fit when pressed together. This particular mounting scheme is especially attractive from an ease of manufacturing standpoint.

In the illustrated embodiment, an Electro-Magnetic Interference (EMI) seal 330 is disposed between the cage body 302 and the host board 320. This EMI seal 330 is preferably comprised of a suitable compliant material so that a tight fit is formed between the board and the cage body, thereby minimizing the release of EMI during operation of modules. Moreover, while different shapes and configurations could be used, the seal 330 is preferably positioned in the region of the host connectors 322 and 324, which corresponds to an area of increased EMI generation. Depending on the particular needs of the system, there may be additional means for minimizing the emission of EMI. For example, the illustrated embodiment further includes an EMI gasket support collar 334 sealed about the port opening so as to further reduce the emission of any EMI. In addition, the illustrated embodiment includes a plurality of conductive fingers 336 and 338 oriented about the inner periphery of the port opening 318 and at an interior rear portion of the chamber 304 along the bottom 312 of the body 302. These EMI containment fingers are resilient so as to maintain electrical contact with the outer housing of the module when it is operatively received within the cage (see e.g., FIGS. 9 and 10). Moreover, they are configured so as to maintain an electrical connection to a chassis ground point or plane, such as a host chassis ground pattern 332 formed on the host printed circuit board 320.

In the particular configuration shown in FIGS. 7 and 8, the size and shape of the port opening 318 and the interior chamber 304 is defined so as to be capable of physically receiving and accommodating a dual width pluggable module (e.g., 200 described above). This is shown further in FIG. 10. Moreover, when operably received through the port 318 and retained within the chamber 304, each of the edge connectors (208 and 208') of the dual width module 200 are electrically and physically interfaced with separate host board connectors 322 and 324.

Also, as noted above, in the illustrated embodiment, the module 200 is equipped with a latching mechanism 218 formed along both of its sides. As can be seen in FIG. 10, this latching mechanism includes a latching edge surface 219 that engages with a corresponding edge formed on a resilient latching tab 340 formed along a corresponding point in the cage body 302 (see FIG. 7). Thus, when the module 200 is operatively received within the port 318, the latching tab 340 flexes until it can engage with the latching edge surface 219. The module 200 is now secured within the cage chamber 304. To release the module 200, the user activates the bail latch release lever 220, which cause the sliding latch 218 to disengage the resilient latching tab 340 which in turn frees the latching edge surface 219. The user can then remove the module 200 from the port 318. Further details regarding this type of latching mechanism are disclosed in the above-identified "XFP Transceiver Bail" application, which is incorporated herein by reference. Of course, other latching mechanisms could also be used.

As noted, the present cage system 300 can also be easily adapted to allow receipt of a module having a different profile. In the illustrated embodiment, the cage system 300 can be altered so that, instead of operatively receiving a single dual width module 200 as in FIG. 10, it can receive one or two single width modules, such as is demonstrated in FIG. 9. To do so, presently preferred embodiments include means for selectively configuring the cage body port and chamber into multiple sub-chambers and sub-ports. Each of these sub-chambers is then able to receive a smaller pluggable module, and interface that module with a corresponding host board connector (e.g., 322, 324). In the illustrated embodiment, this means for subdividing is comprised of one or more removable septums, designated generally at 400 in FIG. 9, and shown in further detail in FIG. 11. As is represented in FIG. 9, the single chamber 304, and the single access port 318 to the chamber, can be subdivided into two laterally displaced sub-chambers (designated at 402 and 404 in FIG. 9) having two laterally displaced access ports (406 and 408) when the septum 400 is positioned within the main access port 318 and chamber 304. Essentially, the septum 400 provides a dividing wall that now effectively subdivides the single chamber into two laterally displaced module sub-chambers. As can be seen in FIG. 9, each of these sub-chambers has an associated host board connector (322 and 324), and can now be used with a single width module 100.

It will be appreciated that while the illustrated embodiment only shows the use of a single septum to subdivide a chamber in to two chambers, that other combinations could be used. For example, if a "triple" wide module chamber were used, that two septums could used to subdivide a chamber into three sub-chambers.

The septum 400 can be removed through the access port opening 318 defined by the cage body 302. A septum is removable in the sense that the end user can remove or reinsert the septums into the cage body to switch the configuration of the cages between the single-wide configuration and the double-wide configuration.

Further details regarding an embodiment of a septum 400 configuration is shown in FIG. 11. Here, the septum 400 includes a cage latching mechanism 410 that functions to secure the septum 400 within the cage chamber 304, and which can be disengaged by the user when the septum 400 is removed. In the example embodiment, the cage latching mechanism 410 is comprised of a resilient tab member that is biased in an upward direction. When operatively disposed within the chamber 304, the resilient tab member biases so as to engage itself within a latch hole 350 formed in the top surface 310 of the cage body 302 (see FIG. 9). To release the septum 400, the user need merely depress the tab member to disengage it from the latch hole 350, and then remove the septum 400. Other latching schemes could also be used.

In the illustrated embodiment the septum is also equipped with a latching mechanism that engages with the corresponding latch 118 formed on the single-wide modules 100 and that can 4 be manually released so as to disengage the modules when removed by a user. This particular latch implementation, shown at 412 in FIG. 11, is configured in the same way as the latch tab 340 formed on the cage body and previously described in connection with the dual width module.

In the illustrated example, the distal end of the septum 400 further includes guide and securing pins 414. When the septum 400 is properly positioned within the chamber 304, these pins 414 will align with and be received within corresponding holes/slots formed in the rear end of the cage body, and thereby secure and prevent any lateral displacement of the septum.

In addition, the septum 400 can also be configured with conductive EMI fingers 416. These conductive fingers 416 are similar to those formed around the inner periphery of the port 318 (designated at 336) and are positioned on the septum so as to insure that a similar EMI pattern is formed along the inner periphery of the sub-ports 406 and 408. This provides a similar grounding arrangement for a single width module, so as to insure proper EMI containment when the cage chamber is subdivided in to multiple module receiving chambers.

Reference is next made to FIG. 12 which illustrates yet another embodiment of the present system. In this particular configuration, a heat sink assembly, designated at 500, is used to form a portion of the top surface of the cage body 302. In the illustrated embodiment, the top surface 310 of the cage body 302 includes two rectangular openings 360 and 362. These openings are configured so as to operatively receive a heat sink configuration that permits efficient dissipation of heat from operating modules.

In the embodiment shown in FIG. 12, the particular heat sink configuration is comprised of dual heat sink structures 510 and 512. The heat sink structures are made of any appropriate heat dissipating material, and in this particular embodiment, include a plurality of individual riding heat-sink members 502. Additional details can be found in co-pending U.S. Provisional Patent Application entitled "Modular Cage With Heat Sink For Use With Pluggable Module," having Ser. No. 10/434,928 and filed on May 9, 2003. That application is incorporated herein by reference in its entirety.

In the embodiment of FIG. 12, the heat sink structures 510 and 512 are implemented as "riding" heat sinks. In this embodiment, the heat sinks 510, 512 are not rigidly mounted to the cage body. Instead, they are each supported on the top surface within each opening 360 and 362 via a spring clip 504. The spring clip 504 attaches to the side walls of the cage body 302 via clips 512 and 514 and corresponding retention holes 508 and 510. The clip 504 includes spanning resilient arms 520 which, when mounted, bias the heat sinks 510 and 512 against the surface of the module disposed within the corresponding chamber. This insures a good thermal contact with the module(s) and provides for efficient removal of heat. Note that this heat assembly arrangement can be used with the septum 400 installed (FIG. 13) or with it removed (FIG. 15).

An alternative heat sink arrangement is shown in FIG. 18. This arrangement utilizes a single heat sink structure 600 that is rigidly affixed to the top surface of the cage body 302 so as to and span both sub chambers (if the septum is installed, as is shown in FIG. 18). Note that in this particular embodiment, the top surface 310 includes only a single heat sink opening, designated at 620 in FIG. 19. In this particular embodiment, proper thermal contact is provided by way of a plurality of leaf springs 602 (or similar type of biasing mechanism) that are oriented on the bottom internal surface of the cage. These leaf springs 602 bias an inserted module so as to force it against the conductive surface of the heat sink 600 to provide a good conductive interface. In this situation, the leaf spring presses on the underside of the module, while the top surface of the module is pressed onto the rigidly attached heat sink. Again, this heat sink arrangement is used with the septum installed (FIGS. 18 and 21), or with it removed (FIGS. 19 and 20).

The rigidly attached heat sink 600 can include a groove or another feature on the heat conductive surface that guides or otherwise constrains the motion of the septum when the septum is inserted and withdrawn from the cage and when the septum is in position in the cage. This groove or feature may simply be a channel into which the septum fits, or may have a latching mechanism slot 622 (in which case, it would be part of the septum engagement mechanism of the cage that secures the septum), that is capable of accommodating the latch 410 formed on the septum 400.

The remaining figures, FIGS. 22–23, further illustrate some of the previously described embodiments in various states of assembly and operation.

The cage assembly may be mounted onto the host board by the manufacturer (usually with other cages on the same board). The septum is generally positioned within the cage during mounting, to provide structural support for the cage as it is press fit and is also in position when it is shipped.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A pluggable module for use with a cage that is adapted to receive modules of different widths, the pluggable module comprising:

a module body; and a plurality of module connectors, wherein, when the pluggable module is received by the cage, each of the plurality of module connectors is connected with a corresponding board connector on a host board on which the cage is mounted; and wherein the cage comprises a septum engagement mechanism for removably securing a septum, and wherein the module body comprises means for engaging with the septum engagement mechanism when the septum is removed and the pluggable module is received by the cage.

2. A pluggable module as recited in claim 1, wherein the module body comprises an optical transceiver.

3. A pluggable module as recited in claim 1, wherein each of two or more of the plurality of module connectors is adapted to receive power from the corresponding board connector.

4. A pluggable module as recited in claim 1, wherein the module body is adapted to be received by a chamber of the cage when all the removable septum that divides the chamber into laterally displaced subchamber is removed.

5. A cage for receiving pluggable modules of different widths and enabling the pluggable modules to be connected to connectors of a host board, the cage comprising:

a cage body that forms a chamber for receiving pluggable modules, the cage body having sidewalls, the cage body further defining an opening for receiving the pluggable modules;

a septum engagement mechanism that is adapted to removably secure a septum, wherein, when the septum is secured by the septum engagement mechanism, the septum subdivides the chamber into laterally displaced subchambers; and a plurality of heat sinks, each being disposed over and corresponding to one of the laterally displaced subchambers and forming a top wall of said corresponding laterally displaced subchamber.

6. A cage as recited in claim 5, wherein each of the plurality of heat sinks is independently attached to the cage body and, when the corresponding laterally displaced subchambers receives a module, is capable of displacement in a direction perpendicular to a plane defined by the top wall.

7. A cage for receiving pluggable modules of different widths and enabling the pluggable modules to be connected to connectors of a host board, the cage comprising:

a cage body that forms a chamber for receiving pluggable modules, the cage body having sidewalls, the cage body further defining an opening for receiving the pluggable modules;

a septum engagement mechanism that is adapted to removably secure a septum, wherein, when the septum is secured by the septum engagement mechanism, the septum subdivides the chamber into laterally displaced subchambers; and a heat sink that is attached to the cage body and defines a top wall of each of the laterally displaced subchambers.

8. A cage as recited in claim 7, wherein the heat sink is substantially rigidly attached to the cage body, the cage body comprising a plurality of leaf springs on a bottom wall opposite the top wall, wherein, when the chamber receives a pluggable module, at least one of the plurality of leaf springs biases the pluggable module against the heat sink.

9. A cage as recited in claim 8, wherein the plurality of leaf springs comprises a first leaf spring associated with a first of the laterally displaced subchambers and a second leaf spring associated with a second of the laterally displaced subchambers.

10. A cage as recited in claim 8, wherein at least a portion of the septum engagement mechanism is formed on the heat sink such that, when the septum is secured by the septum engagement mechanism, the septum is attached to the heat sink.

11. A cage as recited in claim 10, wherein the heat sink has defined thereon a longitudinal groove that constrains motion of the septum when the septum is received by or removed from the cage.

12. A septum for subdividing a chamber of a cage that receives pluggable modules, the septum comprising:

a septum body having:

a cage engagement mechanism that permits the septum to be removably secured by the cage; and a first side and an opposite second side that, when the septum is received by the cage, define a wall of a first subchamber and a second subchamber, respectively, of the cage;

a first latching mechanism on the first side that is adapted to removably secure a pluggable module in the first subchamber; and a second latching mechanism on the second side that is adapted to removable secure a plug able module in the second subchamber; and means formed on the septum for permitting a user to selectively disengage the first latching mechanism so as to release a pluggable module from the first subchamber.

13. A heat sink for use with a cage that receives pluggable modules of different widths, the heat sink comprises:

a heat transfer surface that is adapted to contact a pluggable module when the pluggable module is received in a chamber of the cage, wherein the heat transfer surface defines a wall of the chamber when the heat sink is attached to the cage;

an attachment mechanism by which the heat sink can be attached to the cage;

a septum engagement mechanism that is adapted to removably engage a septum associated with the cage, wherein, when the septum is engaged by the septum engagement mechanism, the septum subdivides the chamber into laterally displaced subchambers, each adapted for receiving a pluggable module having a first width.

14. A heat sink as recited in claim 13, wherein, when the septum is removed from the septum engagement mechanism, the chamber of the cage is adapted to receive a pluggable module having a second width that is wider than the first width.

15. A cage for receiving pluggable modules of different widths and enabling the pluggable modules to be connected to connectors of a host board, the cage comprising:

a cage body that forms a chamber for receiving pluggable modules, the cage body having sidewalls, the cage body further defining an opening for receiving the pluggable modules;

a septum that, when positioned in the chamber, subdivides the chamber into laterally displaced subchambers;

a septum engagement mechanism that is adapted to removably secure the septum in the chamber; and conductive fingers formed on the cage body and the septum adjacent to the opening, such that the conductive fingers contact a pluggable module when the pluggable module is received by the cage so as to reduce electromagnetic interference from the pluggable module.

* * * * *

UNITED STATES PATENT AND TRADEMARK OFFICE

CERTIFICATE OF CORRECTION

PATENT NO. : 6,986,679 B1
APPLICATION NO. : 10/661941
DATED : January 17, 2006
INVENTOR(S) : Aronson et al.

It is certified that error appears in the above-identified patent and that said Letters Patent is hereby corrected as shown below:

Column 1
Line 39, change “signal” to --signals--
Line 66, change “insure” to --ensure--

Column 2
Line 8, change “insure” to --ensure--
Line 12, before “that also” remove [,]
Line 20, change “desired” to --desire--
Line 26, change “transmit” to --transmission--
Line 66, change “(facilitate” to --facilitate--

Column 5
Line 66, change “insure” to --ensure--

Column 6
Line 3, after “claims” insert --,--

Column 9
Line 40, change “corresponds” to --correspond--

Column 10
Line 12, change “cause” to causes--
Line 30, after “module” remove [,]
Line 47, after “that” insert --,--
Line 49, remove [that]
Line 51, change “that two septums could” to --two septums could be--
Line 60, change “is” to --are--

Column 11
Line 9, remove [4]
Line 26, change “insure” to --ensure--
Line 29, change “insure” to --ensure--
Line 32, after “FIG. 12” insert --,--
Line 63, change “insures” to --ensures--

UNITED STATES PATENT AND TRADEMARK OFFICE

CERTIFICATE OF CORRECTION

PATENT NO. : 6,986,679 B1
APPLICATION NO. : 10/661941
DATED : January 17, 2006
INVENTOR(S) : Aronson et al.

It is certified that error appears in the above-identified patent and that said Letters Patent is hereby corrected as shown below:

Column 12
Line 4, remove [and]
Line 27, before "that is capable" remove [,]
Line 35, after "mounting" remove [,]

Column 14
Line 14, change "plug able" to --plugable--

Signed and Sealed this

Twenty-sixth Day of February, 2008

JON W. DUDAS
*Director of the United States Patent and Trademark Office*